US005777634A

United States Patent [19]

Okamura et al.

[11] Patent Number: 5,777,634

[45] Date of Patent: Jul. 7, 1998

[54] APPARATUS OR INSTRUMENT INCLUDING SCANNING TYPE FUNCTIONAL ELEMENT

[75] Inventors: Yoshitaka Okamura, Kawasaki; Yoichi Tosaka, Yokohama; Kenichirou Hashimoto, Yokohama; Hirofumi Hirano, Yokohama; Kosuke Yamamoto, Yokohama; Hiroshi Nakai, Yokohama; Yoshinori Watanabe, Tokyo, all of Japan

[73] Assignee: Canon Kabushiki Kaisha, Tokyo, Japan

[21] Appl. No.: 534,040

[22] Filed: Sep. 26, 1995

[30] Foreign Application Priority Data

| | | | |
|---|---|---|---|
| Sep. 26, 1994 | [JP] | Japan | 6-230086 |
| Sep. 14, 1995 | [JP] | Japan | 7-237098 |
| Sep. 14, 1995 | [JP] | Japan | 7-237187 |
| Sep. 22, 1995 | [JP] | Japan | 7-244892 |

[51] Int. Cl.[6] ..... B41J 2/195; B41J 29/38

[52] U.S. Cl. ..... 347/7; 347/14

[58] Field of Search ..... 347/43, 7, 40, 347/104, 50, 14, 85; 177/45

[56] References Cited

U.S. PATENT DOCUMENTS

| | | | |
|---|---|---|---|
| 3,930,258 | 12/1975 | Dick et al. . | |
| 4,590,494 | 5/1986 | Ichihashi et al. | 347/7 |
| 4,796,782 | 1/1989 | Wales et al. . | |
| 4,852,604 | 8/1989 | Wales et al. . | |
| 4,921,132 | 5/1990 | Wales et al. . | |
| 5,018,884 | 5/1991 | Hirano et al. | 347/43 |
| 5,165,708 | 11/1992 | Hirano et al. | 347/43 |
| 5,617,122 | 4/1997 | Numata et al. | 347/14 |

FOREIGN PATENT DOCUMENTS

| | | |
|---|---|---|
| 0227232 | 7/1987 | European Pat. Off. . |
| 2605559 | 8/1977 | Germany . |
| 62-25216 | 2/1987 | Japan . |
| 278557 | 3/1990 | Japan . |
| 3159750 | 7/1991 | Japan . |
| 60-26838 | 2/1994 | Japan . |

*Primary Examiner*—N. Le
*Assistant Examiner*—Thinh Nguyen
*Attorney, Agent, or Firm*—Fitzpatrick, Cella, Harper & Scinto

[57] ABSTRACT

A black ink cartridge is mounted on a carriage capable of scanning along a guide shaft, and when a projection of the carriage rides on a sensor within the scanning range of the carriage, the weight of the black ink cartridge is detected.

45 Claims, 26 Drawing Sheets

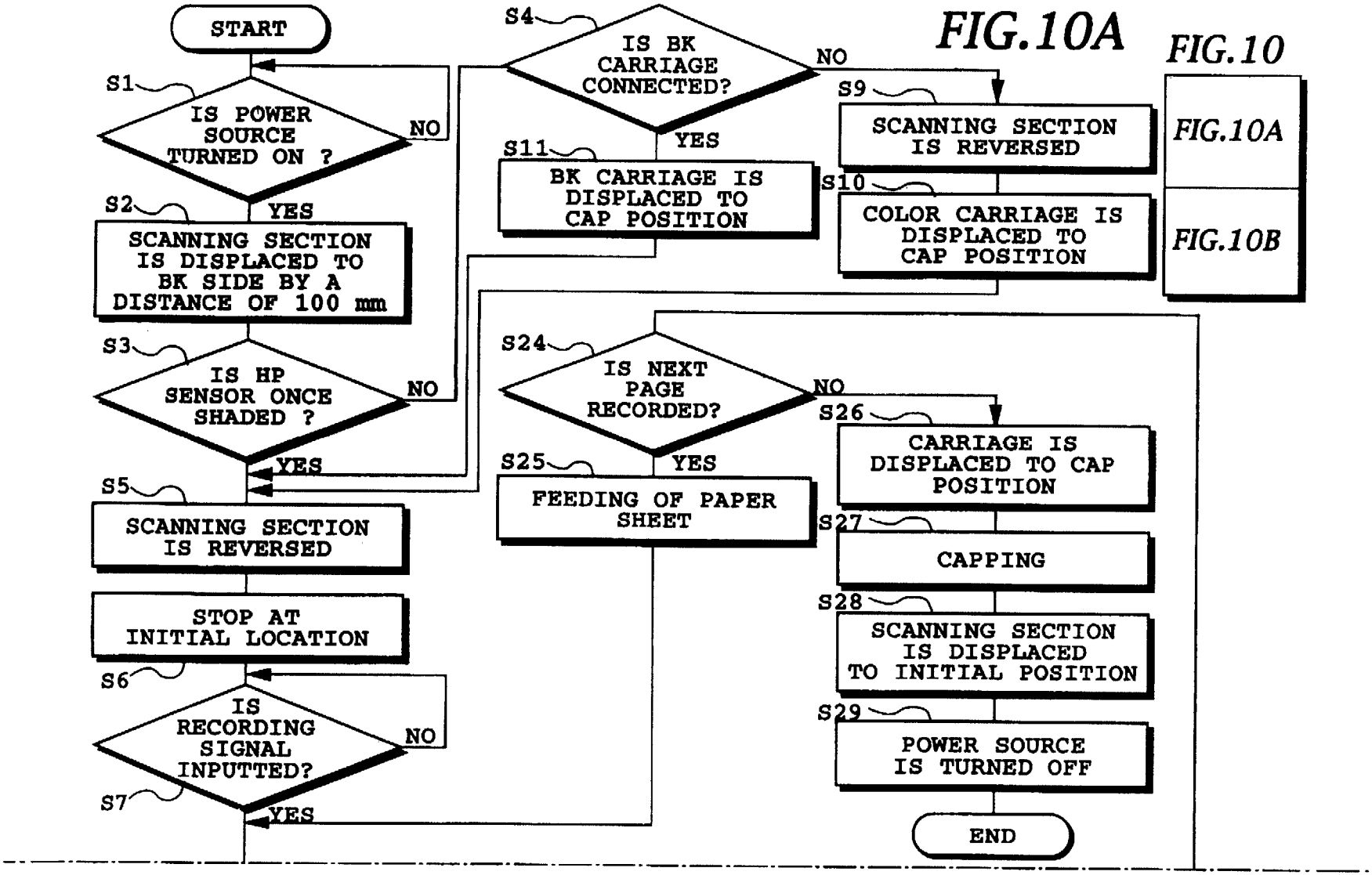
FIG.10
FIG.10A
FIG.10B
FIG.10A
START
S1
IS POWER SOURCE TURNED ON ?
NO
YES
S2
SCANNING SECTION IS DISPLACED TO BK SIDE BY A DISTANCE OF 100 mm
S3
IS HP SENSOR ONCE SHADED ?
NO
YES
S4
IS BK CARRIAGE CONNECTED?
NO
YES
S9
SCANNING SECTION IS REVERSED
S10
COLOR CARRIAGE IS DISPLACED TO CAP POSITION
S11
BK CARRIAGE IS DISPLACED TO CAP POSITION
S5
SCANNING SECTION IS REVERSED
S6
STOP AT INITIAL LOCATION
S7
IS RECORDING SIGNAL INPUTTED?
NO
YES
S24
IS NEXT PAGE RECORDED?
NO
YES
S25
FEEDING OF PAPER SHEET
S26
CARRIAGE IS DISPLACED TO CAP POSITION
S27
CAPPING
S28
SCANNING SECTION IS DISPLACED TO INITIAL POSITION
S29
POWER SOURCE IS TURNED OFF
END

APPARATUS OR INSTRUMENT INCLUDING SCANNING TYPE FUNCTIONAL ELEMENT

BACKGROUND OF THE INVENTION

1. Field of the Invention

The present invention relates generally to a recording apparatus and an apparatus or instrument including a scanning type carrier or a scanning type carriage. More particularly, the present invention relates to a recording apparatus and various kind of apparatus or instrument which becomes active by allowing an ink jet head or a reading sensor to scan as a functional element.

2. Statement of the Related Art

Conventionally, in the field of ink recording, there is known a method of judging that an ink ribbon has been completely used when a portion different from a recording portion (e.g., a white colored portion) disposed on a thin tape such as an ink ribbon or the like is optically detected.

In the field of an ink jet recording apparatus, there is known a method of detecting an ink level in an ink tank that is an ink supply source or an ink level in a sub-tank located in an ink supply passage. In this connection, a technology that a flexible film is disposed in this sub-tank and an ink level in the sub-tank is kept constant by optically measuring a light reflective portion of the flexible film of which position varies as a quantity of ink increases or decreases is disclosed in Japanese Patent Application Laid-Open No. 168571/1983. Although the flexible film is disposed at a portion to be measured, this technology is effective but a problem is that the portion to be measured is complicated in structure, causing it to be fabricated at a expensive cost.

In addition, a technology that a quantity of ink remaining in an ink tank is judged by concretely measuring a quantity of ink consumed from the ink tank is disclosed in Japanese Patent Application Laid-Open No. 19467/1993.

The technology consists in judging a quantity of ink consumed by recording and a quantity of ink consumed by recovering on the total basis, and therefore, is a very effective invention.

To assure that a quantity of ink in an ink tank is visually recognized, the ink tank is molded of a transparent synthetic resin so as to enable an operator to judge the quantity of ink in the ink tank with his eyes. This concept is known by many prior patent applications.

The present invention has been made in consideration of a problem that it becomes necessary to define the structure of a portion to be measured by machining the foregoing portion with a conventional method of judging a quantity of remaining ink as well as a phenomenon of no ink when ink is used for recording. Indeed, the present invention has been made based on a technical recognition that in the case that a functional element such as an ink tank mounted on a scanning type carriage is taken as a portion to be measured, it is important that a quantity of remaining ink can be judged without any complicated machining or working conducted on the functional element while not restrictively defining an object.

Especially, the present invention has been reached from a standpoint that when a flexible film of which position varies depending on a quantity of ink is employed for a scanning type carriage like the prior invention described in Japanese Patent Application Laid-Open No. 168571/1983, the flexible film is displaced by the vibration of ink, causing measurement to be conducted with much measuring errors, resulting in the flexible film failing to be put in practical use.

Moreover, the present invention has been reached from the background that although the prior invention disclosed in Japanese Patent Application publication No. 19467/1993 is excellent, when an ink tank having a large quantity of holding ink passes the state that the usage environment varies from season to season, the consumption of ink from a recording head fluctuates with the result that there arises an occasion that a quantity of remaining ink can not exactly be judged.

SUMMARY OF THE INVENTION

The present invention is intended to obtain a stable judgment reference regardless of the structure of an article to be measured and without any complicating of the structure of the article by obtaining direct information on the article to be measured but not indirect information on the same in a recording apparatus.

Therefore, an object of the present invention is to provide a recording apparatus and an apparatus or instrument including a scanning type carrier which assures that a quantity of ink remaining in an ink tank and the state of a functional element are exactly seized by detecting the weight of the ink tank mounted on a carriage of the recording apparatus and the weight of a functional element mounted on the scanning type carrier, while preventing an occurrence of a malfunction of no ink attributable to variation of the foregoing state.

Other object of the present invention is to provide an apparatus or instrument including a scanning type carrier which assures that the state of a functional element can exactly be seized, e.g., an ink jet head and a reading sensor are selectively scanned as functional elements with simple structure, various operational manner can be obtained corresponding to the kind of the functional elements, and the functional elements are easily held in the standby state, whereby the apparatus or instrument can simply be constructed with smaller dimensions.

Another object of the present invention is to provide a recording apparatus and an apparatus or instrument including a scanning type carriage which assures that e.g., an ink jet head and a reading sensor mounted on the carriage as functional elements can be discriminated with simple structure.

In a first aspect of the present invention, there is provided a recording apparatus for performing recording by scanning a carriage on which a recording head and an ink tank can be mounted, comprises:

detecting means for directly detecting the substantial weight of an ink tank corresponding to a quantity of ink received in the ink tank, the detecting means being located within a scanning range of the carriage.

Here, the recording apparatus may further comprise:

judging means for judging a quantity of usage of ink in the ink tank when the detected weight of the detecting means becomes a predetermined weight or less.

The detecting means may include a determining level for determining the presence or absence of an ink tank to be mounted on the carriage.

In a second aspect of the present invention, there is provided an apparatus or instrument including a scanning type carrier for scanning on receipt of the driving force and a guide mechanism for making it possible to scan the scanning type carrier, comprise:

a first standby location capable of holding a functional element on one end side;

a second standby location capable of holding a functional element on the other end side as seen in the scanning direction;

wherein the guiding mechanism makes it possible that the scanning type carrier moves between the first standby location and the second standby location and the scanning type carrier is movable together with the functional element located at least one of the first standby location and the second standby location, and detecting means for detecting the weight of at least one of the functional elements.

Here, the apparatus or instrument may comprise:

a first carriage located at the first standby location for mounting a first functional element;

a second carriage located at the second standby location for mounting a second functional element; and wherein the first and second carriages each including electrical contacts for activating the each functional element and a mechanism for positioning the each functional element, and the scanning carrier mounts one of the first and second functional elements by placing one of the first and second carriages.

The first and second carriages may be swingably engaged with the guiding mechanism; and may further comprise:

first and second mechanisms for restricting swinging movement of the first and second carriages at the first and second standby locations, respectively, and wherein the scanning type carrier includes an engagement mechanism for restricting swinging movement of the carriages in mounting one of the carriages thereon.

The functional element mounting carriages each may engage with the scanning type carrier so as to allow a receiving portion of the driving force of the scanning type carrier to intervene in the projected space of the carriage in the perpendicular direction relative to the scanning direction.

Before the functional element mounting carriages each receives engagement for pulling/releasing with the scanning type carrier, it may perform restrictive engagement for restricting the relative positional relationship relative to the scanning type carrier.

The scanning type carrier may comprise electrical contacts for activating a mounted functional element and a mechanism for positioning the mounted functional element.

In a third aspect of the present invention, there is provided an apparatus or instrument including a scanning type carrier for scanning on receipt of the driving force and a guide mechanism for making it possible to scan the scanning type carrier, comprises:

a first standby location including a functional element mounting carriage capable of holding a functional element in the mounted state and adapted to be swingably engaged with the guide mechanism and a mechanism for restricting swinging movement of the functional element mounting carriage on the one end side, the guide mechanism making it possible to scan the scanning type carrier at the first standby location and within the information processing range where the functional element functions; and wherein the scanning type carrier integrally mounts the functional element located at the first standby location and includes an engagement mechanism for restricting swinging movement of the functional element; and detecting means for detecting the weight of the functional element.

In a fourth aspect of the present invention, there is provided an apparatus or instrument including a scanning type carrier for scanning on receipt of the driving force and a guide mechanism for making it possible to scan the scanning type carrier, comprises:

a first standby location including a functional element mounting carriage capable of holding a functional element in the mounted state and adapted to be swingably engaged with the guide mechanism and a mechanism for restricting swinging movement of the functional element mounting carriage on the one end side, the guide mechanism making it possible to scan the scanning type carrier at the first standby location and within the information processing range where the functional element functions;

wherein the scanning type carrier integrally mounts the functional element located at the first standby location and restricts swinging movement of the functional element;

wherein the functional element mounting carriage receives engagement with the scanning type carrier so as to allow a receiving portion of the driving force of the scanning type carrier to intervene in the projected space of the carriage in the perpendicular direction relative to the scanning direction, and detecting means for detecting the weight of the functional element.

In a fifth aspect of the present invention, there is provided an apparatus or instrument including a scanning type carrier for scanning on receipt of the driving force and a guide mechanism for making it possible to scan the scanning type carrier, comprises:

a first standby location including a functional element mounting carriage capable of holding a functional element on the one end side as seen in the scanning direction, the guide mechanism making it possible to scan the scanning type carrier at the first standby location and within the information processing range where a functional element functions;

wherein the scanning type carrier integrally mounts the functional element located at the first standby location, and the functional element mounting carriage receives engagement with the scanning type carrier so as to allow a receiving portion of the driving force of the scanning type carrier to intervene in the projected space of the carriage in the perpendicular direction relative to the scanning direction; and detecting means for detecting the weight of the functional element.

In a sixth aspect of the present invention, there is provided an apparatus or instrument including a scanning type carrier for scanning on receipt of the driving force and a guide mechanism for making it possible to scan the scanning type carrier, comprises:

a first standby location including a functional element mounting carriage capable of holding a functional element in the mounted state on the one end side as seen in the scanning direction, the guide mechanism making it possible to scan the scanning type carrier at the first standby location and within the information processing range where the functional element functions;

wherein the scanning type carrier integrally mounts the functional element located at the first standby location, and before the functional element mounting carriage receives engagement for pulling/releasing by the scanning type carrier, it performs restrictive engagement for restricting the relative positional relationship relative to the scanning type carrier, and detecting means for detecting the weight of the functional element.

In a seventh aspect of the present invention, there is provided an apparatus or instrument including a scanning type carrier and a guide mechanism for making it possible to scan the scanning type carrier, comprises:

a first standby location capable of mounting an ink jet head and an ink tank on the one end side;

a second standby location capable of mounting an ink jet head and an ink tank on the other end side as seen in the scanning direction;

a first capping mechanism for capping the ink jet head located at the first standby location;

a second capping mechanism for capping the ink jet head located at the second standby location;

wherein the guide mechanism makes it possible that the scanning type carrier can move between the first standby location and the second standby location, and moreover, the scanning type carrier can move together with the ink jet head and the ink tank located at either one of the first standby location and the second standby location; and detecting means for detecting the weight of at least one of the ink tanks.

In an eighth aspect of the present invention, there is provided an apparatus or instrument including a scanning type carrier and a guide mechanism for making it possible to scan the scanning type carrier, comprises:

a first standby location exclusively usable for a carriage for mounting an ink jet head and an ink tank on the one end side;

a second standby location exclusively usable for a carriage for mounting a functional element different from the ink jet head on the other end side as seen in the scanning direction;

wherein the guide mechanism makes it possible that the scanning type carrier moves between the first standby location and the second standby location, and moreover, the scanning type carrier moves together with the carriage located at either one of the first standby location and the second standby location; and detecting means for detecting the weight of the functional element.

In a ninth aspect of the present invention, there is provided an apparatus or instrument comprises:

a scanning type carrier;

a first standby location for making it possible that a first functional element can be mounted on the one end side;

a second standby location for making it possible that a second functional element can be mounted on the other end side as seen in the scanning direction;

a guide mechanism for making it possible that the scanning type carrier can move between the first standby location and the second standby location;

selecting means for selecting a functional element located at either one of the first standby location and the second standby location corresponding to an operating mode of the apparatus or instrument or a functional element driving signal so as to allow the functional element selected to be integrated with the scanning type carrier; and detecting means for detecting the weight of at least one of the first functional element and the second functional element.

In a tenth aspect of the present invention, there is provided a recording apparatus for performing recording by scanning a carriage for making it possible that different functional elements are exchangeably mounted thereon, characterized in that the apparatus includes detecting means for detecting the weight of the carriage within the scanning range of the carriage.

In an eleventh aspect of the present invention, there is provided an apparatus or instrument including a scanning type carriage for making it possible that a functional element can be mounted on the scanning type carriage, comprises:

weight detecting means for detecting substantial weight of the carriage inclusive of the functional element within the scanning range of the carriage.

Here, the weight detecting means may comprise;

a sensor portion for detecting the substantial weight of the carriage and the functional element mounted on the carriage, and a lever portion for transmitting the weight of the carriage and the functional element mounted on the carriage to the sensor portion.

The lever portion of the weight detecting means may have a predetermined length and be turnable about the position located at a predetermined distance from the sensor portion, and in the case that the carriage comes in contact with a predetermined range of the lever portion, the lever portion is turned to transmit the weight of the carriage and the functional element mounted on the carriage to the sensor portion.

The sensor portion and the lever portion may be disposed while they are integrated with each other.

The sensor portion may be disposed separately from the lever portion.

The weight detecting means may detect the weight of the carriage and the functional element mounted on the carriage based on a lever ratio of a distance from the center of turning movement of the lever portion to the sensor portion to a distance from the center of turning movement of the lever portion to the contact position of the carriage.

The weight detecting means may comprise;

means for preliminarily memorizing the relationship between the contact position of the carriage and a weight value detected by the sensor portion, and means for determining any one of the kind of the functional element mounted on the carriage and the presence or absence of the functional element depending on the contact position of the carriage when the weight detecting means gets an output and the content of the memorizing means.

The weight detecting means may comprise means for amending the once set content of the memorizing means.

The weight detecting means may comprise;

calculating means for obtaining the detected weight from information on the contact position of the carriage in the case that a lever ratio is preliminarily given, and determining means for determining any one of the kind of the functional element mounted on the carriage and the presence or absence of the functional element based on the result derived from calculation conducted by the calculating means.

The weight detecting means may include means for correcting the content of the calculating means.

In a twelfth aspect of the present invention, there is provided a recording apparatus comprises;

a scanning carriage making it possible to mount a functional element inclusive of an ink jet head for performing recording on a recording medium by ejecting ink and an ink tank for receiving ink to be supplied to the ink jet head, and weight detecting means for detecting the substantial weight of the carriage inclusive of the functional element within the scanning range of the carriage.

Here, the ink jet head and the ink tank can be attached to and detached from the carriage.

The ink tank can be attached to and detached from the ink jet head.

The weight detecting means may comprise;

a sensor portion for detecting the substantial weight of the carriage and the functional element mounted on the carriage, and a lever portion for transmitting the weight of the carriage and the functional element mounted on the carriage to the sensor portion.

The lever portion of the weight detecting means may have a predetermined length and is turnable about the position located at a predetermined distance from the sensor portion, and in the case that the carriage comes in contact with a predetermined range of the lever portion, the lever is turned and transmits the weight of the carriage and the functional element mounted on the carriage to the sensor portion.

The sensor portion and the lever portion may be disposed while they are integrated with each other.

The sensor portion may be disposed separately from the lever portion.

The weight detecting means may detect the weight of the carriage and the functional element mounted on the carriage based on a lever ratio of a distance from the turning movement center of the lever portion to the sensor portion to a distance from the turning movement center of the lever portion to the contact position of the carriage.

The weight detecting means may comprise;

means for preliminarily memorizing the relationship between the contact position of the carriage and a weight value detected by the sensor portion, and judging means for judging any one of the kind of the functional element mounted on the carriage and the presence or absence of the functional element depending on the contact position of the carriage when the weight detecting means gets an output and the content of the memorizing means.

The weight detecting means may comprise means for amending the once set content of the memorizing means.

The weight detecting means may comprise;

calculating means for obtaining the detected weight from information on the contact position of the carriage in the case that a lever ratio is preliminarily given, and judging means for judging at least one of the kind of the functional element mounted on the carriage, the presence or absence of the functional element, and the weight of ink of the ink tank from the result derived from calculation conducted by the calculating means.

The weight detecting means may include means for correcting the content of the calculating means.

In a thirteenth aspect of the present invention, there is provided an ink jet recording apparatus comprises:

recording means for performing recording on a recording medium by ejecting ink;

a carriage for making it possible to mount the recording means, the carriage being supported to slide in the longitudinal direction of a guide shaft extending in parallel with the surface of the recording medium, and moreover, turn about the guide shaft;

means for restricting turning movement of the carriage;

weight detecting means disposed within the sliding range of the carriage for detecting at least the weight of the carriage, and a projection disposed on the carriage to transmit the weight of the carriage and the recording means mounted on the carriage to the weight detecting means by allowing the projection to come in contact with the weight detecting means to release restriction of the turning movement of the carriage induced by the turning movement restricting means.

Here, the weight detecting means may be disposed within the sliding range of the carriage and outside the recording range defined by the recording means.

The recording means may include an ink jet head for ejecting ink to the recording medium and an ink tank for receiving ink to be supplied to the ink jet head.

The ink jet head can be attached to and detached from the carriage.

The ink tank can be attached to and detached from the ink jet head.

The carriage turning movement restricting means may be a retaining plate for restricting a distance between the recording medium and the recording means.

In a fourteenth aspect of the present invention, there is provided a remaining ink quantity detecting mechanism comprises:

a carriage for making it possible to mount an ink tank for receiving ink to be supplied to an ink jet head for ejecting ink to a recording medium, the carriage being supported to slide in the longitudinal direction of a guide shaft extending in parallel with the surface of the recording medium, and moreover, turn about the guide shaft, weight detecting means disposed within the sliding range of the carriage to detect at least the weight of the carriage, and a projection for transmitting the weight of the carriage and the ink tank mounted on the carriage to the weight detecting means by coming in contact with the weight detecting means.

In a fifteenth aspect of the present invention, there is provided a functional element discriminating method of discriminating a functional element mounted on a carriage capable of sliding in a predetermined direction, comprises the steps of;

actuating weight detecting means for detecting the weight of the carriage and the functional element by a projection disposed on the functional element, and discriminating the kind of the functional element from the result of detection.

Here, the kind of the functional element may be discriminated by allowing the carriage to stop at the position corresponding to the kind of the functional element by changing the position of the projection in the sliding direction of the carriage corresponding to the kind of the functional element.

In a sixteenth aspect of the present invention, there is provided a functional element discriminating mechanism for discriminating a functional element mounted on a carriage capable of sliding in a predetermined direction, comprises:

a projection disposed on the functional element;

weight detecting means for detecting the weight of the carriage and the functional element by contact of the projection, and discriminating means for discriminating the kind of the functional element from the result of detection conducted by the weight detecting means.

Here, the projection may be disposed at the position which is changed in the sliding direction of the carriage corresponding to the kind of the functional element, and the carriage is stopped at the position corresponding to the kind of the functional element.

A functional element discriminating mechanism may further comprise;

judging means for judging the kind of the functional element mounted on the carriage and the state of the same by detecting the stop position of the carriage corresponding to the kind of the functional element, and moreover, detecting a detection level of the weight detecting means.

The functional element may include a plurality of projections, and in the case that the carriage is stopped at plural positions, the weight of the carriage is detected by the weight detecting means.

BRIEF DESCRIPTION OF THE DRAWINGS

FIG. 10 comprising FIGS. 10A and 10B are a flowchart which explains operations in accordance with the ninth embodiment of the present invention;

DESCRIPTION OF THE PREFERRED EMBODIMENTS

Figure 1:
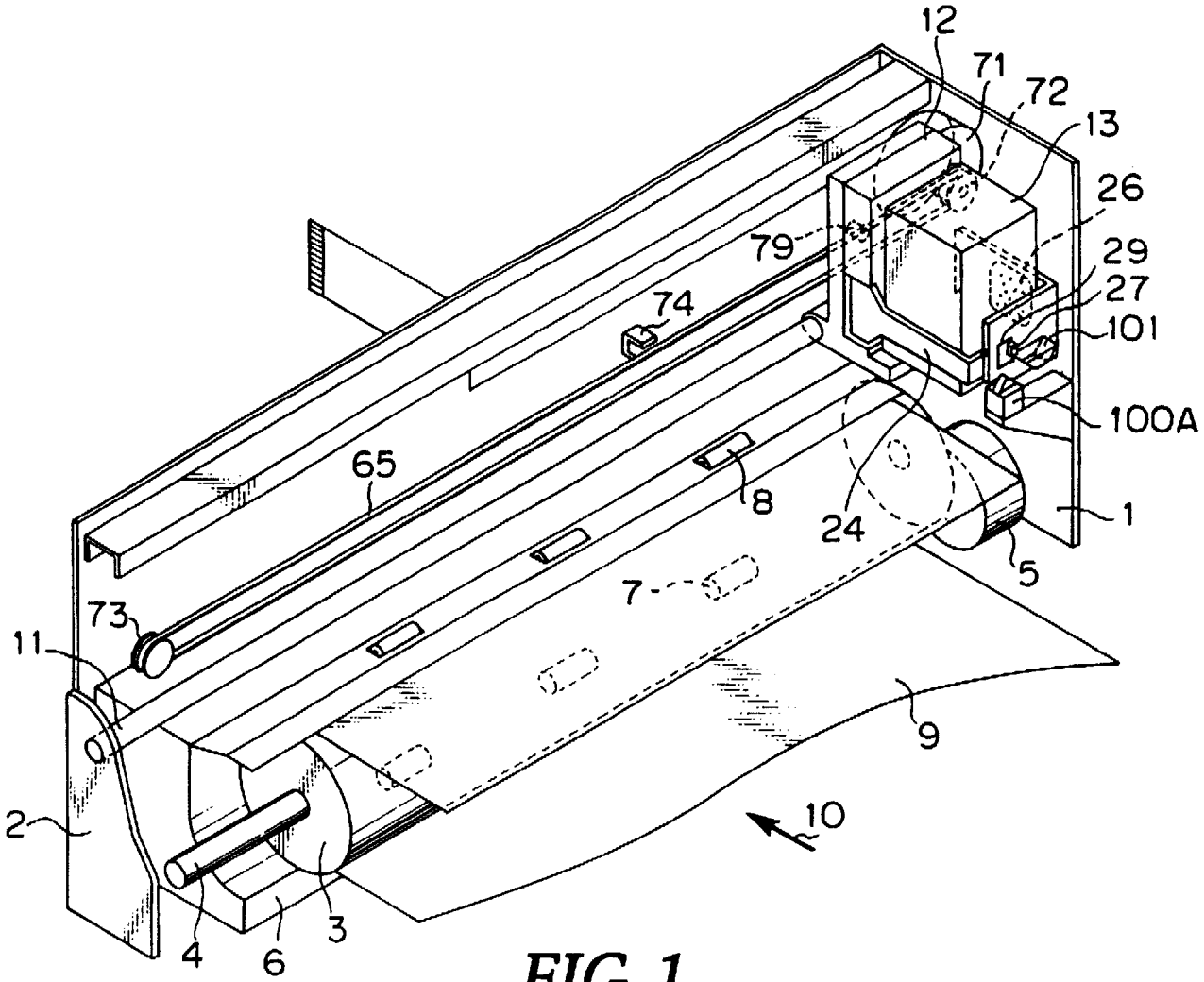
FIG. 1 is a perspective view showing the whole structure of a first embodiment of the present invention.

The present invention will now be described in detail hereinafter with reference to the accompanying drawings which illustrate preferred embodiments thereof. It should be noted that same components throughout all the drawings are represented by same reference numerals and repeated description on them are herein omitted.

Further, it should be noted that in the present specification, several technical terms are defined in the following manner. "Medium to be conveyed" involves a sheet of paper, a sheet of OHP, a processed sheet, a cloth or a similar recording medium and a photograph, a carrier sheet, a document sheet or a similar sheet material. "functional element" involves a recording head and a reading head, "carriage" represents that a functional element is mounted thereon, "carrier" represents an article which is scanned while receiving driving force but does not directly includes a functional element, and "information processing range" involves a recording range and a reading range.

(First Embodiment)

Figure 2:
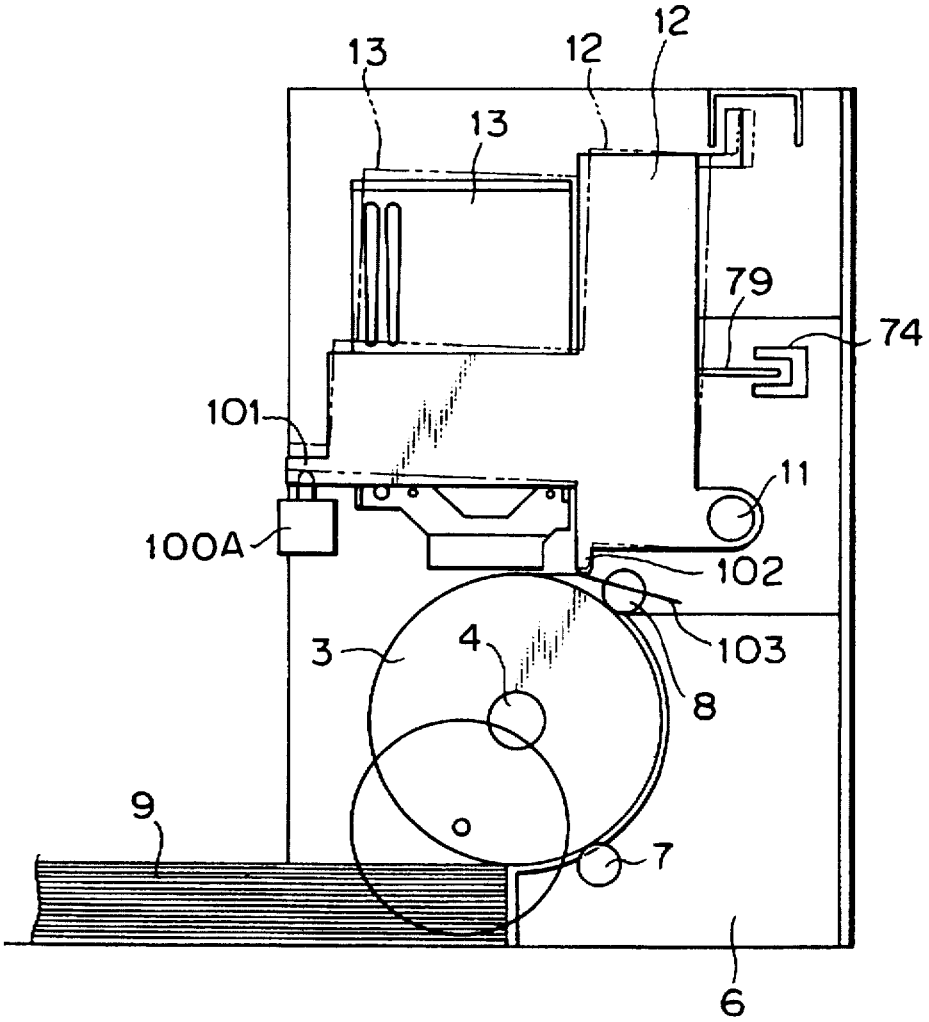
FIG. 2 is a side view of an essential part of a recording apparatus shown in FIG. 1.

FIG. 1 and FIG. 2 illustrate a first embodiment of the present invention.

This embodiment shows by way of example that the present invention is applied to an ink jet recording apparatus. As a belt 65 extending between a motor pulley 72 and a tension pulley 73 is displaced by a carrier motor 71, a carriage 12 connected to the belt 65 is scanned in the leftward/rightward direction while displacement of the carriage 12 is guided by a guide shaft 11 extending between a right-hand side plate 1 and a left-hand side plate 2. An ink cartridge such as a black ink cartridge 13 or the like is mounted on the carriage 12 in such a manner as to enable the cartridge 13 to be exchanged with another one by actuating a hook 24. The black ink cartridge 13 includes an ink tank for storably receiving black ink therein and an ink jet recording head serving as a functional element adapted to eject black ink.

While the cartridge 13 is scanned together with the carriage 12 in the leftward/rightward direction, ink is ejected from the recording head, and as a recording paper sheet 9 is fed in the arrow-marked direction represented by reference numeral 10 with the aid of a platen roller 3 driven by a paper sheet feeding motor 5, a paper guide 6 and pinch rollers 7 and 8, recording operation is performed for the recording paper sheet 9. Reference numeral 4 denotes a platen roller shaft, and reference numeral 26 denotes a contact portion which is formed in the carriage 12. An ink ejection signal serving as a functional element driving signal is given to the recording head of the cartridge 13 by way of the contact portion 26. In addition, reference numeral 74 denotes a light permeating type home position sensor, and reference numeral 79 denotes a sensor shielding plate disposed on the carriage 12 side to shield the detecting light of the sensor 4.

As shown in FIG. 2, the carriage 12 is turnable about the guide shaft 11, and by allowing a slider 102 to come in slidable contact with a paper retaining plate 103, turnable movement of the carriage 12 in the leftward direction as seen in FIG. 2 is prevented while restricting the distance between the recording head of the cartridge 13 and the recording paper sheet 9.

A projection 101 is disposed on the carriage 12, and a sensor 100A serving as a weight detecting means located on the displacement locus of the projection 101 is disposed on the right-hand plate 1. When the projection 101 is located above the sensor 100A, the projection 101 rides on the sensor 100A. Inclined surfaces extending in the leftward and rightward directions are formed on a portion of the projection 101 facing to the sensor 100A so as to assure that the riding of the projection 101 is smoothly effected. Various kind of load cells can be used as the sensor 100A without any restriction only to a specific type. In this embodiment, the projection 101 faces to the sensor 100A between the rightward scanning limit position as a waiting position of the carriage 12 and the scanning range for recording operation.

As represented by phantom lines in FIG. 2, when the carriage 12 is displaced so as to allow the projection 101 to ride on the sensor 100A, the slider 102 is parted away from the paper retaining plate 103 so that the weight of the carriage 12 inclusive of that of the cartridge 13 can be detected. The detected weight is reduced as ink in the ink tank of the cartridge 13 is increasingly consumed. For this reason, a quantity of remaining ink can be detected from the detected weight, and moreover, whether remaining ink is present or absent can be determined. In other words, substantial weight of the ink tank corresponding to a quantity of ink accommodated in the ink tank can directly be detected by the sensor 100A. Here, the phrase of "substantial weight of the ink tank" is used to mean the weight of the ink tank only, the weight of a recording head unit integrated with the ink tank or the weight of a moving body for scannably supporting the recording head unit integrated with the ink tank. It is preferable that the substantial weight of the ink tank becomes a preferable object to be detected as it is near to the weight of a single ink tank. Since the projection 101 rides on the sensor 100A outside of the scanning range of the carriage 12 for performing a recording operation, it does not obstruct the scanning/recording of the carriage.

Here, description will be made with respect to decision on whether a quantity of remaining ink is present or absent.

In the case that a weight of the cartridge 13 is reduced as ink is consumed, there arises a difference of about 35 grams between when the ink tank is fully filled with ink and when the ink tank is empty. When it is set that the sensor 100A outputs a detection signal before the ink tank becomes empty (e.g., when ink is consumed by a quantity of about 25 grams), it can be determined that a quantity of remaining ink becomes about 10 grams. At this time, a user can be noticed to replace the cartridge 13 with a new one by issuing an advance notice of "a small quantity of ink is remaining".

Figure 3:
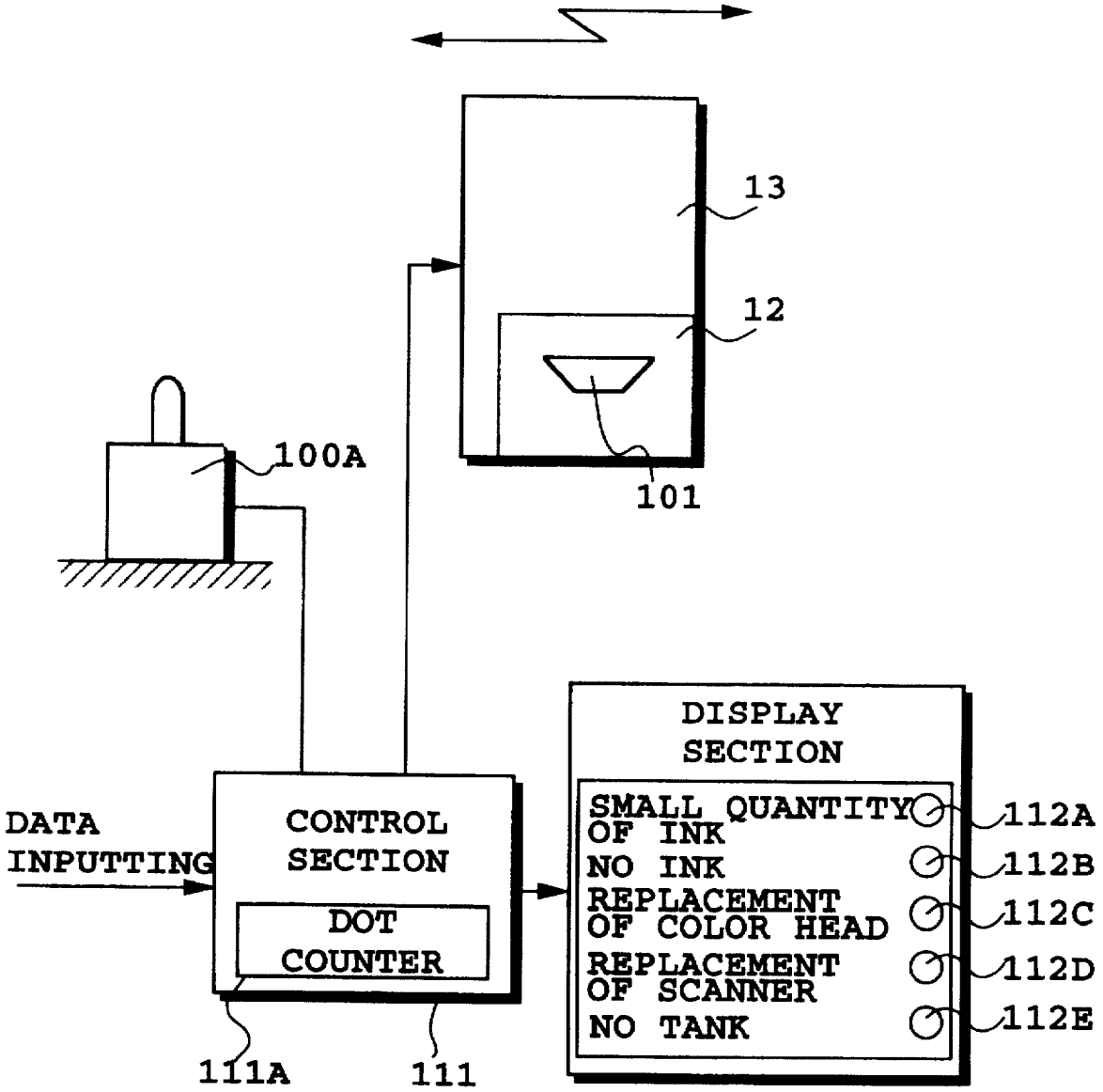
FIG. 3 is a block diagram which shows a control system for the recording apparatus shown in FIG. 1.

FIG. 3 shows by way of example a display section 112 to be connected to a control section 111 of the ink jet recording apparatus. This display section 112 may be disposed on the recording apparatus or it may be disposed on the host computer side for controlling the recording apparatus or supplying recording data to the recording apparatus.

The display section 112 includes an advance notice portion 112A of "a small quantity of ink is remaining" which notifies that a quantity of remaining ink is reduced to a predetermined quantity and a warning portion 112B of "no ink" which warns that a quantity of remaining ink is reduced to such an extent that a recording operation is incorrectly performed. In addition, in this embodiment, the control section 111 discriminates the kind of a cartridge mounted on the carriage 12 based on the weight detected by the sensor 100A, and moreover, it can request the display section 112 to mount a cartridge corresponding to input data. Specifically, a display portion 112C of "replacement of a color head" is disposed to request that a color ink cartridge is mounted on the carriages 12 in place of a black ink cartridge 13, and a display portion 112D of "replacement of a scanner" is disposed to request that a scanner is mounted on the carriage 12 in place of the ink cartridge. Incidentally, concrete structure of a color ink cartridge and a scanner will be explained in another embodiment to be described later. A display portion 112E of "no tank" is disposed to request that an ink tank is mounted on the carriage 12 having a recording head mounted thereon in the case that a cartridge type ink tank can exchangeably be mounted on the carriage 12.

In the case that a color ink cartridge which is possible to be mounted on the carriage 12 in place of the black ink cartridge 13 exchangeably includes a plurality of cartridge type ink tanks each storably receiving a different color of ink, it can be detected based on the weight detected by the sensor 100A whether the cartridge type ink tanks are mounted on the carriage 12 or not. In this case, it is sufficient that a detection level serving as a determination reference for the detection is set.

In addition, the control section 111 includes a dot counter 111A as a determining means for determining a quantity of used ink. This dot counter 111A counts the number of formed dots corresponding to the number of ejected inks ejected from the recording head, and a quantity of used ink can be determined from the value derived from counting. However, a quantity of ejected ink per one dot is liable to be affected by environmental conditions such as temperature or the like. In view of the foregoing fact, in this embodiment, by looking for a quantity of used ink using the dot counter 111A from the time when it is determined based on the weight of detected by the sensor 100A that a quantity of remaining ink is reduced to a predetermined quantity or less, "no ink" is displayed at the point of time before ink is substantially completely used, causing a recording operation to be incorrectly performed. In other words, after a quantity of remaining ink is reduced to a predetermined quantity or less, the ink detection time is shortened and a period of time that the environmental conditions vary is shortened, determination on a quantity of used ink is made using the dot counter 111A. In such a manner, by combining two methods of detecting a quantity of remaining ink with each other, a quantity of remaining ink can more reliably be detected.

(Second Embodiment)

Figure 14:
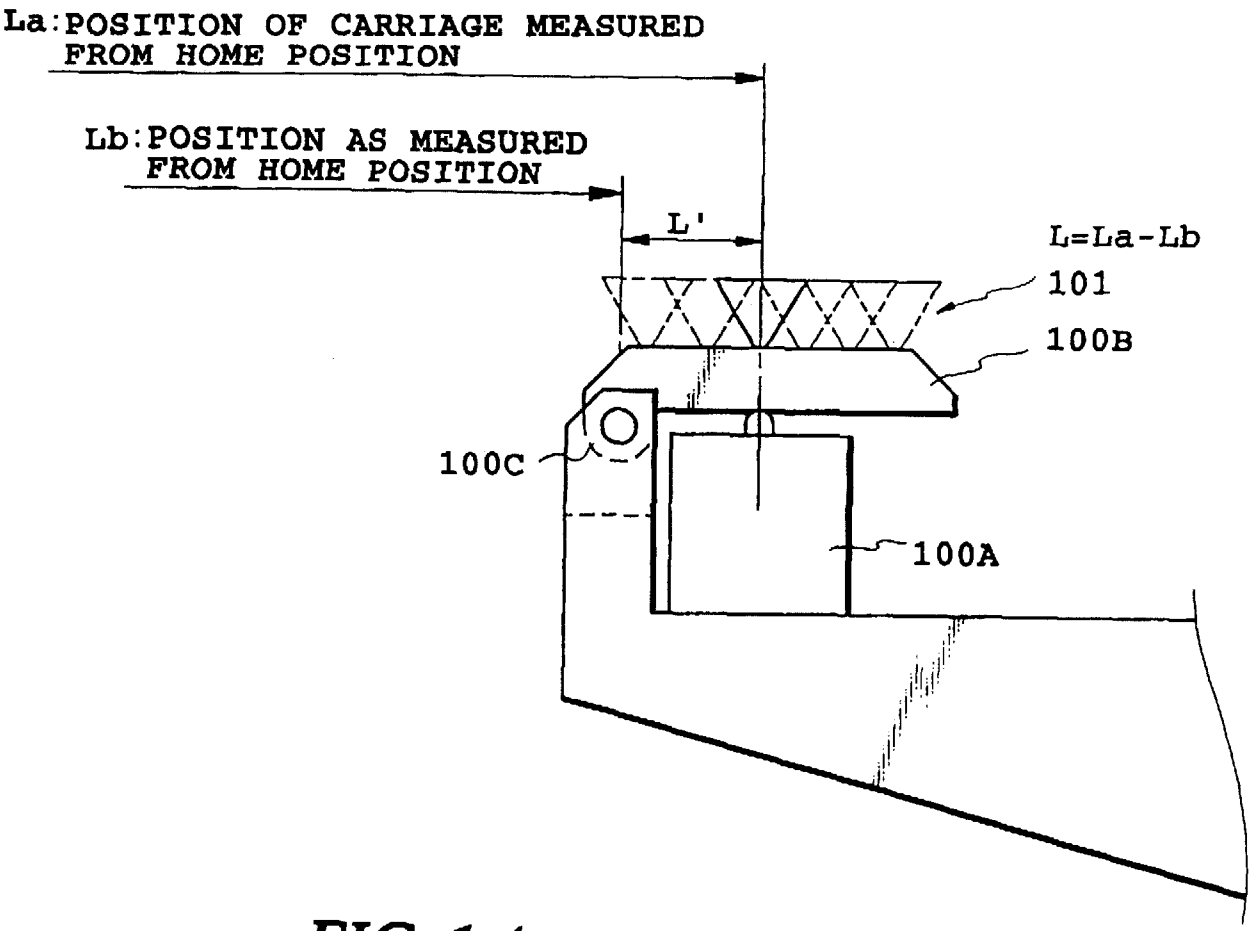
FIG. 14 is a front view of essential parts of the apparatus shown in FIG. 13.
Figure 20:
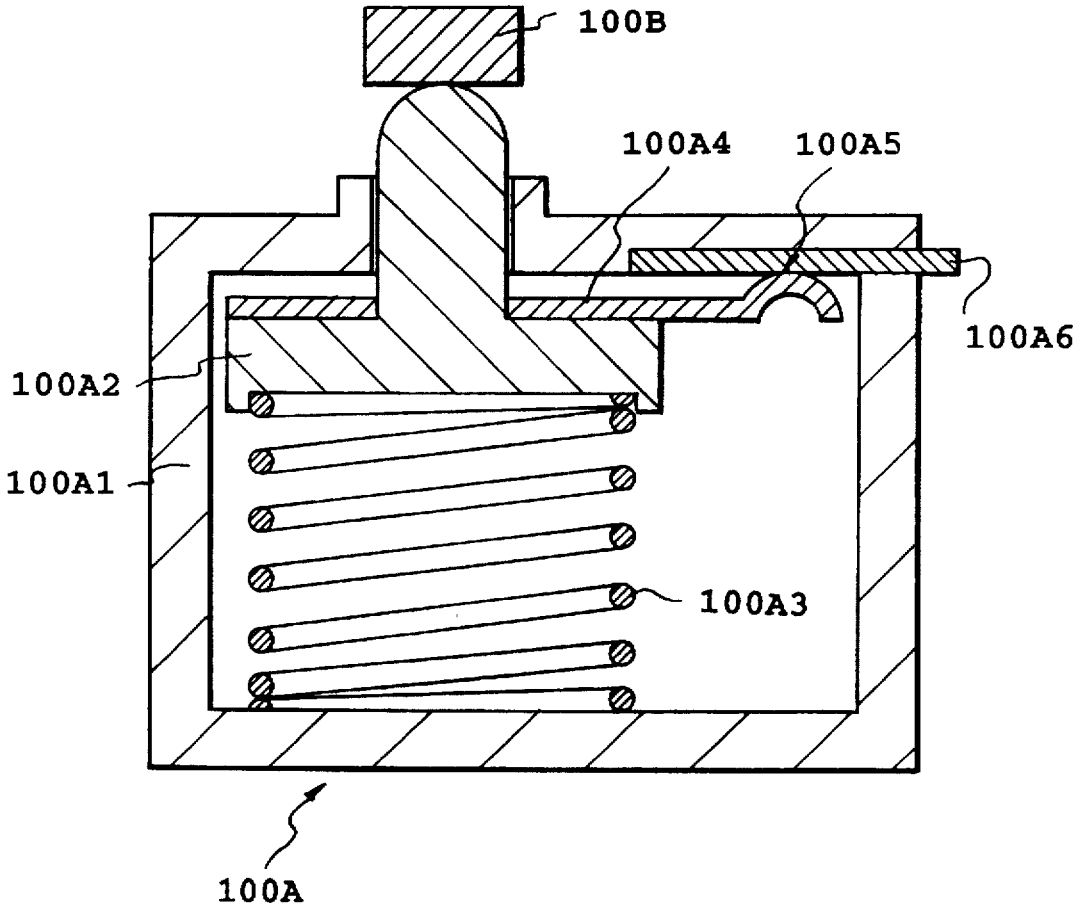
FIG. 20 is a schematic sectional view of a sensor.

A second embodiment of the present invention consists in improving a sensor 100A serving as a weight detecting means located on the locus of displacement of the projection 101 in order to elevate a detection accuracy. Specifically, a lever 100B is disposed between the projection 101 and the sensor 100A so that the projection 101 rides on the lever 100B when it is located in the vicinity of the sensor 100A. The lever 100B is turnably disposed on the sensor 100A located at a predetermined position above a detecting portion of the sensor 100A (see FIG. 18) or on a fitting portion located on the main body side to turn about a turning movement center 100C (see FIG. 14). Inclined surfaces are formed on the left-hand side and the right-hand side of the projection 101 facing to the lever 100B so as to enable the projection 101 to smoothly ride on the lever 100B. Various load cells can be used as the sensor 100A, and one example of the load cell is shown in FIG. 20.

Reference numeral 100A1 denotes a housing having an opening formed through the upper surface thereof. A moving piece 100A2 having an inverted T-shaped sectional contour is received in the housing 100A1. A coil spring 100A3 is interposed between the lower surface of the moving piece 100A2 and the bottom wall of the housing 100A1 so that a detecting portion at the fore end part of the moving piece 100A2 extends through the opening to be projected to the outside.

On the other hand, an electrode 100A4 is placed on the upper surface of the moving piece 100A2 and an electrode 100A5 is disposed on the lower surface of the top wall of the housing 100A1 so that both the electrodes 100A4 and 100A5 normally come in contact with each other by the resilient force of the coil spring 100A3. Reference numeral 100A6 denotes a cable which is electrically connected to the electrode 100A5.

A predetermined set load is given to the coil spring 100A3, and when a predetermined magnitude of load is given the foremost end of the moving piece 100A2 from the lever 100B, both the electrodes 100A4 and 100A5 are parted away from each other so that an OFF signal is obtained via the cable 100A6.

Thus, the sensor 100A does not turn off unless the load given from the lever 100B exceeds the set load of the coil spring 100A3. Namely, when the measured weight is lower than the set load, an ON state is maintained, and the sensor 100A turns off only when the measured weight is larger than the set load.

In this embodiment, the projection 101 is brought in contact with the lever 100B within the range defined between the right-hand scanning limit position serving as a waiting position for the carriage 12 and the scanning range for a recording operation. Therefore, when the carriage 12 is displaced and the projection 101 rides on the lever 100B in the same manner as in the preceding embodiment, a slider 102 is parted away from a paper retaining plate 103 and the weight of the carriage 12 inclusive of the cartridge 13 is transmitted to the sensor 100A via the lever 100B so that the foregoing weight can be detected. Here, a method of transmitting the weight from the lever 100B to the sensor 100A will be described below with reference to FIG. 14.

The turning movement center 100C of the lever 100B is located at the position at a distance L' as seen in the scanning direction of the carriage 12 from the detecting portion at the fore end of the sensor 100A and substantially directly transverse to the detecting portion of the sensor 100A as seen in the direction of a height. Thus, since the tangential direction of rotation at the contact point between the lever 100B and the detecting portion orients in the substantially vertical direction relative to the detecting portion, the following equation is established from the relationship of a lever ratio, when it is assumed that the weight of the carriage at the projection 101 is represented by T and the set weight of the sensor 100A is represented by Ts.

$$Ts \times L' = T \times L \quad (1)$$

(L represents an arbitrary distance from the turning movement center 100C to the contact point between the lever 100B and the projection 101)

Here, since Ts represents a predetermined weight (set weight) from which the sensor 100A obtains an output and L' represents the positional relationship (distance) between the detecting portion of the sensor 100A and the turning movement center 100C, both have a known value, respectively. Thus, when the equation (1) is modified, the following equation is obtainable.

$$T = Ts \times L'/L \quad (2)$$

Thus, if the contact position (L) of the projection 101 on the lever 100B is known, a substantial mass of the carriage can be detected. Here, it is simple to look for L, and when the carriage 12 is scanned in the direction toward the detecting portion of the sensor 100A from the turning movement center 100C side on the lever 100B, the position where an output is first obtained from the sensor 100A represents L. Generally, to assure that a scanning type printer obtains a printing output at a high quality, it is necessary from the viewpoint of controlling to know the position of the carriage, a moving speed or the like. To this end, control of a pulse output and control of feedback of the result derived from an output of an encoder are conducted using a high accuracy pulse motor, an encoder or the like, and moreover, scanning of the carriage is controlled. Therefore, the position of the carriage can exactly be known as a distance (La) from a home position sensor 74 or an abutting portion of the terminal end of the scanning portion. Since the positions (Lb) of the sensor 100A and the lever 100B are already known from the viewpoint of designing, the distance L on the lever 100B is obtainable as the position of the carriage. Controlling is performed by driving the motor corresponding to the number of times of outputting of driving pulses of a pulse motor and the number of outputs from the encoder.

Next, discrimination of a functional element on the carriage 12 based on the weight detected by the sensor 100A and a method of detecting a quantity of remaining ink will be explained below.

Figure 13:
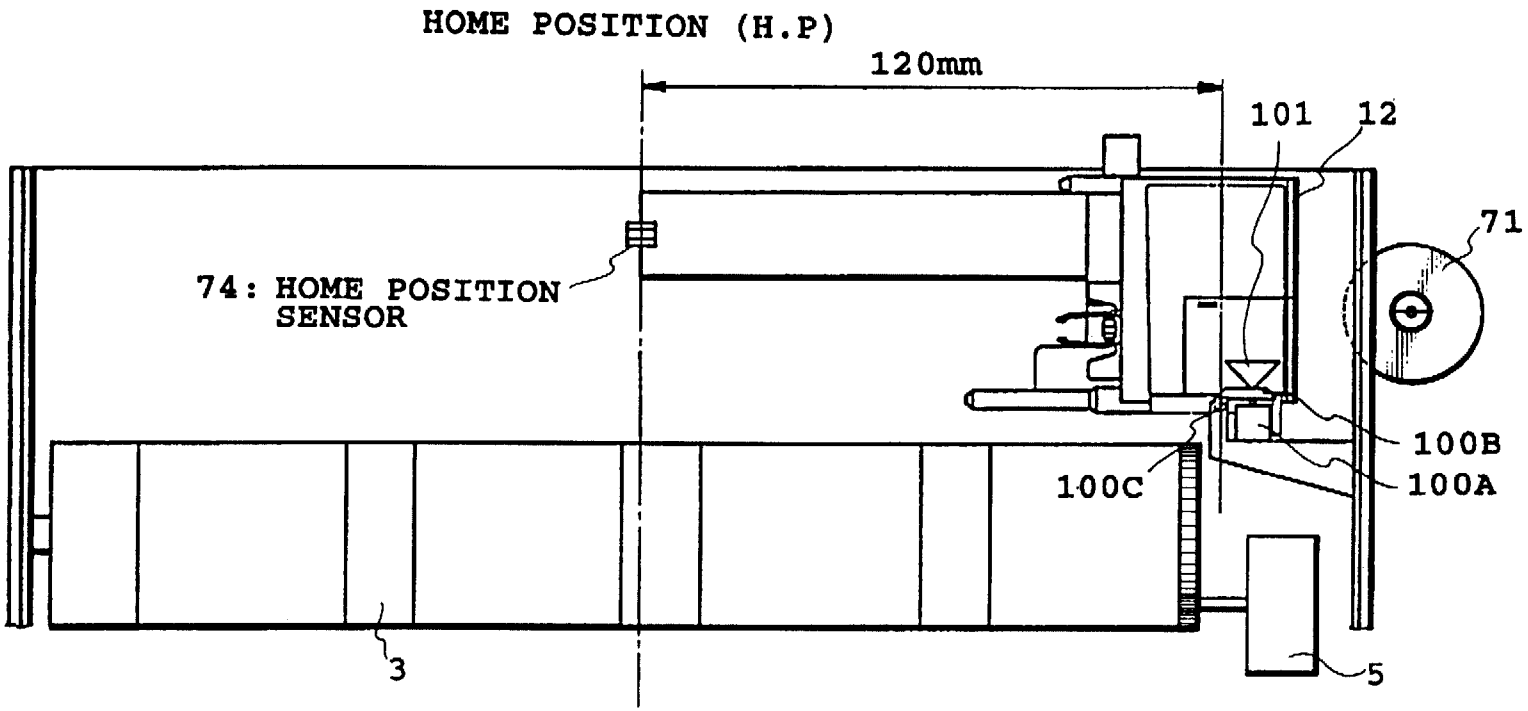
FIG. 13 is a front view of an apparatus constructed in accordance with a second embodiment of the present invention.

As shown in FIG. 13, when it is assumed that the distance from a home position sensor 74 to the turning movement center 100C of the lever 100B is 120 mm, the set weight of the sensor 100A is 45 grams, the distance from the turning movement center C of the lever 100B to the detecting portion of the sensor 100A is 6 mm, and the range where the projection 101 on the lever 100B slidably moves is 12 mm, the detected weight relative to movement of the carriage 12 on the lever 100B per every 0.5 mm is shown in Table 1 in conformity with the equation (2).

TABLE 1

| | POSITION OF CARRIAGE FROM HOME POSITION La (mm) | POSITION OF CARRIAGE ON LEVER L (mm) | WEIGHT DETECTED BY SENSOR T (g) | |
|---|---|---|---|---|
| POSITION OF TURNING MOVEMENT CENTER | 120 | 0 | — | |
| | 121.0 | 1.0 | 270 | |
| | 121.5 | 1.5 | 180.0 | |
| | 122.0 | 2.0 | 135.0 | |
| | 122.5 | 2.5 | 108.0 | |
| | 123.0 | 3.0 | 90.0 | |
| | 123.5 | 3.5 | 77.1 | |
| | 124.0 | 4.0 | 67.5 | |
| | 124.5 | 4.5 | 60.0 | |
| | 125.0 | 5.0 | 54.0 | |
| | 125.5 | 5.5 | 49.1 | |
| POSITION OF SENSOR | 126.0 | 6.0 | 45.0 | (Ts) |
| | 126.5 | 6.5 | 41.5 | |
| | 127.0 | 7.0 | 38.6 | |
| | 127.5 | 7.5 | 36.0 | |
| | 128.0 | 8.0 | 33.8 | |
| | 128.5 | 8.5 | 31.8 | |
| | 129.0 | 9.0 | 30.0 | |
| | 129.5 | 9.5 | 28.4 | |
| | 130.0 | 10.0 | 27.0 | |
| | 130.5 | 10.5 | 25.7 | |
| | 131.0 | 11.0 | 24.5 | |
| | 131.5 | 11.5 | 23.5 | |
| | 132.0 | 12.0 | 22.5 | |

Therefore, it becomes possible to discriminate the kind of each functional element and a quantity of remaining ink by allocating them to the detected weight (T) at each carriage position (La). For example, as shown in FIG. 15, when it is assumed that the weight detected by the sensor 100A is 90 grams or more in the case of a scanner, it is 60 grams or more (at empty of ink) to less than 90 grams (at full of ink) in the case of a black cartridge storing a black ink only for monochromatic printing, and it is 60 grams or less in the case of a color cartridge, to/from which a black ink tank storing a black ink only and a color ink tank storing color ink attachable/detachable, for color printing (monochromatic printing is also possible) with both the black ink tank and the color ink tank being full of inks, respectively, it is possible to discriminate the kind of a functional element on the carriage 12 depending on the position of the carriage 12 when an output from the sensor 100A is obtained.

When it is assumed that the detected weight of a color cartridge is 24.5 grams or more (at empty of a black ink) to less than 30 grams (at full of a black ink) in the state that only a black ink tank is attached the color cartridge, and the detected weight of the color cartridge is 35.5 grams or more (at empty of color ink) to less than 45 grams (at full of color ink) in the state that only a color ink tank is attached to the color cartridge, it is possible to discriminate the presence or absence of the ink tanks on the color cartridge as follows: both the black ink tank and the color ink tank are not attached to the color cartridge when the detected weight of the color cartridge is less than 24.5 grams; the black ink tank only attached to the color cartridge when the detected weight of the color cartridge is 24.5 grams or more to less than 30 grams; the color ink tank only is attached to the color cartridge when the detected weight of the color cartridge is 30 grams or more to less than 45 grams; and both the black ink tank and the color ink rank are attached to the color cartridge when the detected weight of the color cartridge is 45 grams or more to less than 60 grams.

In addition, it is possible to detect a quantity of remaining ink (quantity of used ink) depending on the detected weight when a black or a color cartridge is mounted, and moreover, it is possible to display messages, warning or the like on a display panel or a screen of a host computer corresponding to a quantity of remaining ink (quantity of used ink).

Figure 15:
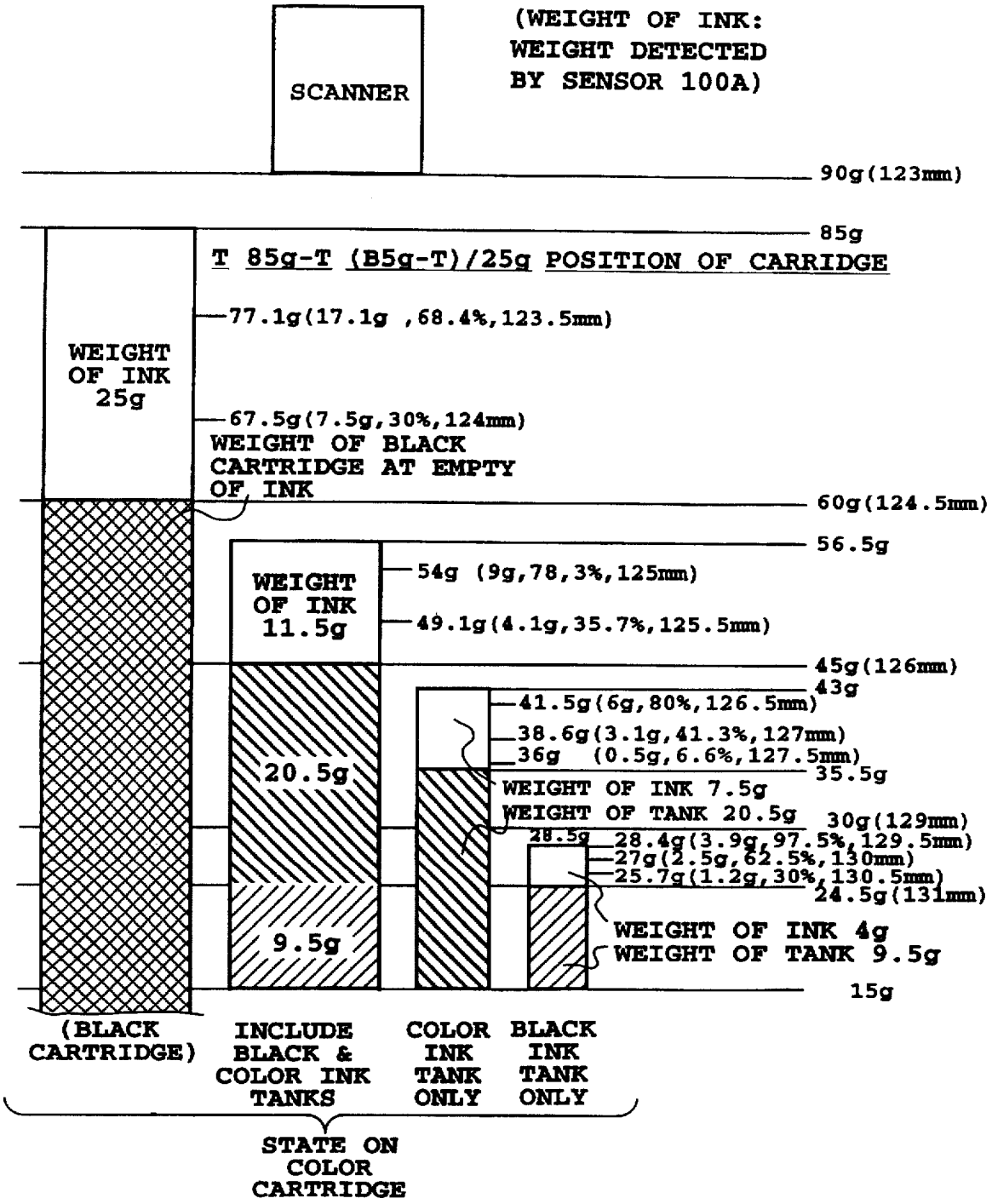
FIG. 15 is a correlative diagram which shows distribution of the kind of each functional element and the state of the same corresponding to numerical table shown in Table 1.
Figure 16:
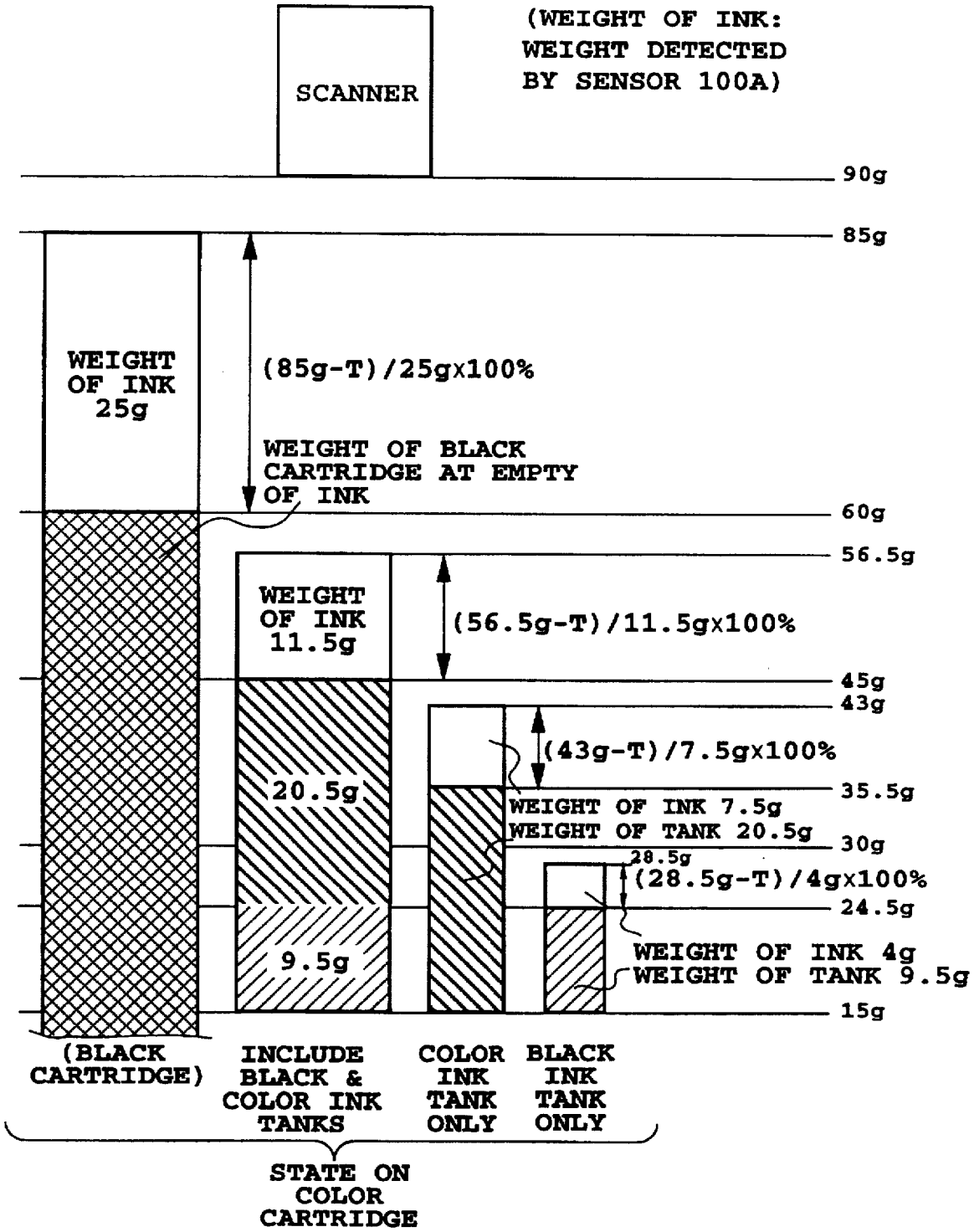
FIG. 16 is a correlative diagram which shows the kind of each functional element and the state of the same in a third embodiment of the present invention.

The aforementioned discrimination is possible by equipping with a discriminating means for making discrimination by comparing the relationship between the position of the carriage, the kind of a functional element corresponding to Table 1 and FIG. 15 and memorized in a control section on the printer main body side or a memorizing section on the host computer side, and the state of the functional element such as variation of a quantity of remaining ink or the like with the position of the carriage at the time when an output is practically obtained with the sensor 100A.

Here, "detected weight" and "substantial ink weight" are a synonym, and involve the weight of scanner, the weight of ink tank only, the weight of recording head unit integrated with ink tank or the weight of moving body for making it possible to scan the recording head unit integrated with ink tank. Incidentally, since the projection 101 rides on the lever 100B outside of the scanning range of the carriage 12 for performing a recording operation, recording/scanning of the carriage 12 is not obstructed.

The relationship between the sensor 100A and the lever 100B is not represented only by the equation (2), and it is obvious that it adequately varies depending on the position of the turning movement center C, the contour of the lever 100B or the like.

Figure 19:
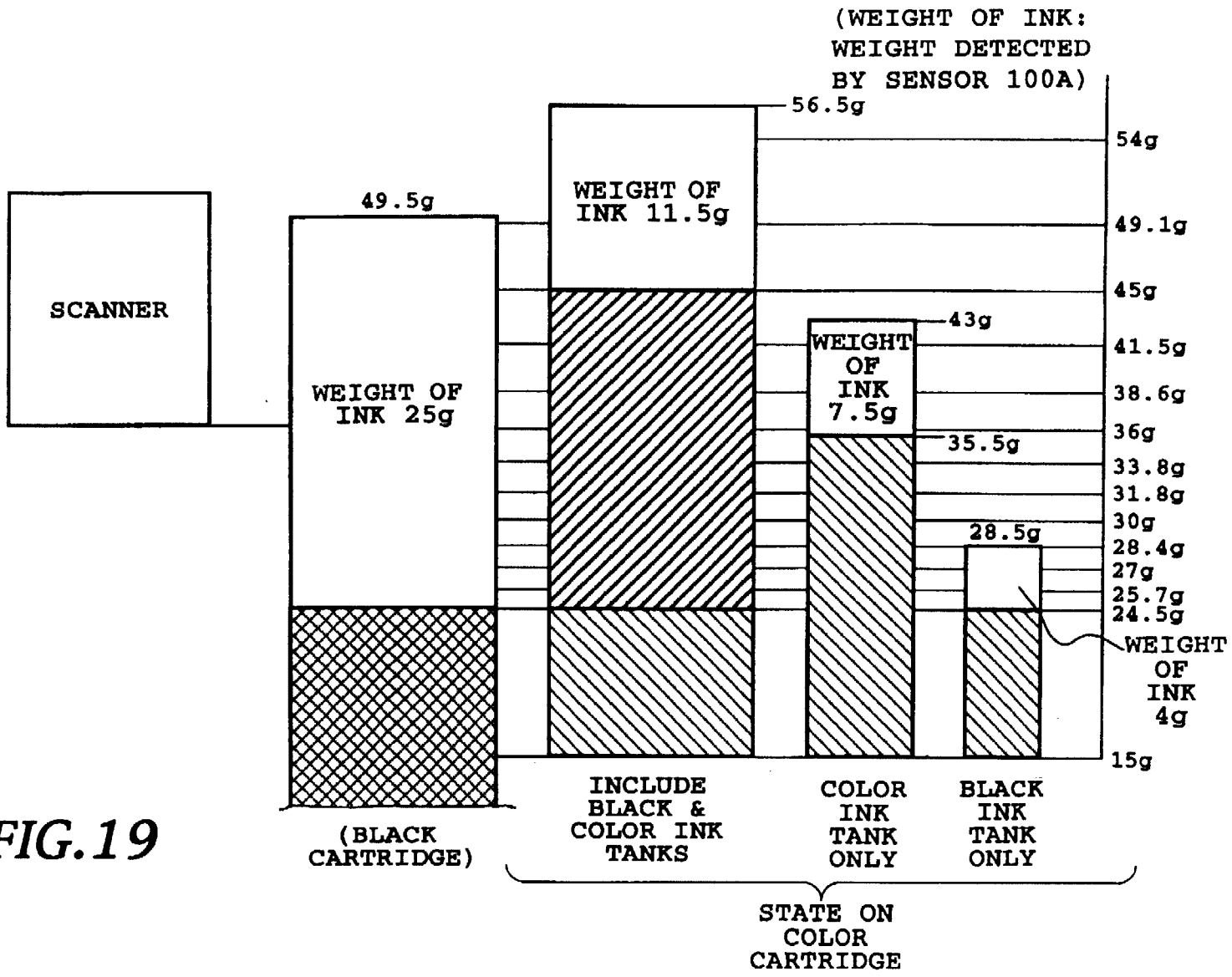
FIG. 19 is a correlative view which shows the detected weight and the state of each functional element when the kind of each functional element is discriminated by other sensor or electrical connection in accordance with a second embodiment of the present invention.

In the preceding embodiment, all discrimination of each functional element is made by the weight sensor 100A but if it is possible to discriminate each functional element by a sensor in the carriage 12 or by the control section via electrical connection, there is no need of distributing the respective functional elements into separate weight ranges as shown in FIG. 15, and the weight range for each functional element can be set within the same weight range as shown in FIG. 19. Thus, it becomes possible to more finely detect a quantity of remaining ink (or a quantity of already used ink). Moreover, if it is possible to determinate as to whether there are ink tanks on the color cartridge or not by the control section, there is no need of setting the respective weight of ink tanks such that the above weight ranges do not overlap, resulting in being able to increase a quantity of ink stored in each ink tanks.

(Third Embodiment)

In the preceding second embodiment, since weight setting for discriminating the kind of each functional element and the state of the same is restricted, it is sufficient to employ a method of making collation and discrimination while the relationship between the position of the carriage 12 and the respective functional elements is memorized in a memorizing portion as it is as shown in FIG. 15. However, if it is intended to exactly seize a quantity of remaining ink received in the ink tank at all times, it is necessary that a pitch of movement of the carriage 12 on the lever 100B is made finer. The minimum pitch of movement of the carriage in the scanning direction is equal to one pulse when a pulse motor is used, and it is equal to one pitch of an encoder when control is conducted using the encoder. Thus, it is possible to substantially continuously displace the carriage 12 considerably finer than a pitch of 0.5 mm in the preceding embodiment. Therefore, provided that the weight range is distributed per each functional element, if the detected weight at the time when a cartridge or an ink tank is fully filled with ink is already known, discrimination of the kind of each functional element can be made, and moreover, a quantity of remaining ink can be known in the form of (detected weight at the time when the ink tank is fully filled with ink—T)/(weight of ink fully filled in the ink tank)×100%.

Since the movement of the carriage is substantially continuous, the detected weight T can exactly be detected in conformity with the equation (2) T=Ts×L'/L. Thus, discrimination of the kind of each functional element and the state of the same is possible by equipping with a discriminating means including a memorizing portion in which the weight range for each functional element is memorized and a calculating portion for obtaining T by calculation in conformity with a modified equation of T=Ts×L' (La–Lb) modified from the equation (2) while using the position La of the carriage 12 at the time when the sensor 100A obtains an output so that the kind of a functional element placed on the carriage at present and the state of the same are discriminated by comparing the thus obtained detected weight T with the data memorized in the memorizing portion. The calculating portion performs calculation in conformity with the calculating formula for a quantity of remaining ink (detected weight at the time when an ink tank is fully filled with ink—T)/(weight of ink fully filled in the ink tank)×100%. When the results derived from the calculation are shown on the screen of a displaying portion on the printer main body side or the host computer side, a user can visually confirm a quantity of remaining ink at all times while preventing an unexpected occurrence of malfunction of "no ink".

(Fourth Embodiment)

In the aforementioned second and third embodiments, description has been made such that data in the memorizing portion, i.e., the weight range of each functional element, data associated with the position of the carriage 12, the set weight Ts of the sensor 100A itself at the calculating portion and the distance Lb from the home position to the turning movement center 100C (or the detecting portion) are unchangeable data. However, a large merit can be obtained by making it possible to change or amend these data at the time when an apparatus is assembled.

For example, in the case that the home position sensor 74 is parted away from the sensor 100A and several parts are interposed between the positions they are fitted, there sometimes arises an occasion that the distance between the home position sensor 74 and the sensor 100A is measured with errors. In such a case, the actual position of the sensor 100A (or the turning movement center 100C) can be known by placing an article having predetermined weight on the carriage 12 at the time when an apparatus is assembled, scanning over the lever 100B, and detecting the position of the carriage 12 at the time when an output is first obtained from the sensor 100A. The error induced by the assembling operation can be minimized by correcting or amending the data associated with the position of the sensor 100A at the memorizing portion or the calculating portion. Thus, it becomes possible to obviate variations from an apparatus to an apparatus.

Figure 17:
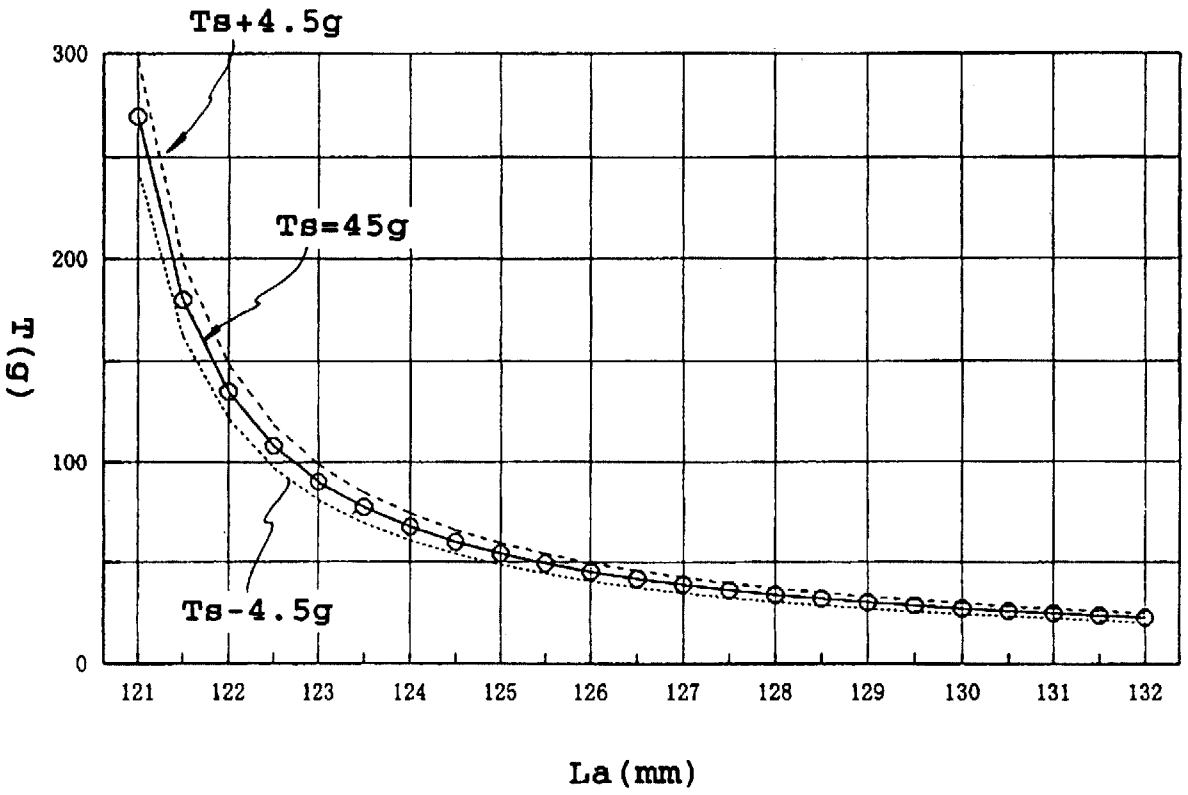
FIG. 17 is a graph which shows the position of a carriage and the detected weight of the same in the third embodiment of the present invention.

On the contrary, when the distance between the home position sensor 74 and the sensor 100A (or the turning movement center 100C) is exactly assembled, it is possible to make exact detection even though the set weight Ts of the sensor 100A itself has some error. For example, in the case that the sensor 100A itself has an error of 10%, in the example shown on Table 1, Ts=45 g±4.5 g, causing a width of error to become 9 grams. Also in such a case, the actual set weight Ts of the sensor 100A is obtainable in conformity with an equation Ts=T×L/L'=T×(La–Lb)/L' modified from the equation (2) by placing an article having predetermined weight (T) on the carriage 12, scanning the carriage 12 on the lever 100B, and knowing the position (La) of the carriage 12 at the time when an output is first obtained from the sensor 100A. Thus, it becomes possible to make exact detection by correcting or amending the data associated with the detected weight of the sensor 100A at the memorizing portion and the calculating portion. In this case, as shown by a graph of FIG. 17, the position of the carriage 12 and the detected weight have difference corresponding to the extent of variation of the set weight Ts. This difference can be coped with by setting the length of the lever 100B so as to enable a minimum weight which is desirably detected when the set weight Ts is ultimately dislocated to the plus side to be detected. Therefore, also in the case that the detected weight of the sensor 100A has some error, it is possible to make exact weight detection without any variations.

Figure 18:
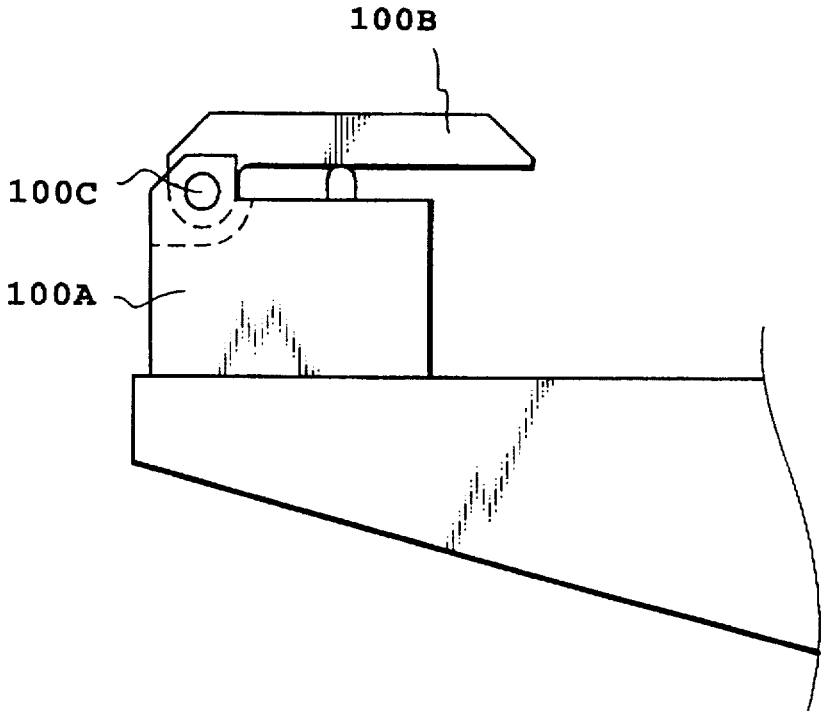
FIG. 18 is a front view of essential parts which explain other pattern of a lever relative to the sensor of the present invention; .

The aforementioned embodiment has been described such that the sensor 100A and the lever 100B are secured to a side plate, but it is possible to further elevate an accuracy by disposing the lever 100B and the turning movement center 100C directly on the sensor 100A as shown in FIG. 18.

(Fifth Embodiment)

Figure 4A:
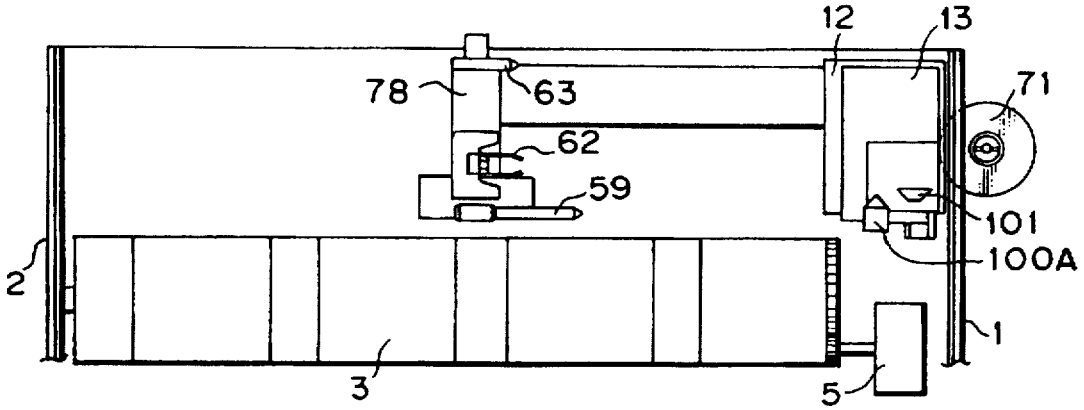
FIG. 4A to FIG. 4C are front views which show essential parts of a fifth embodiment of the present invention, respectively.
Figure 4B:
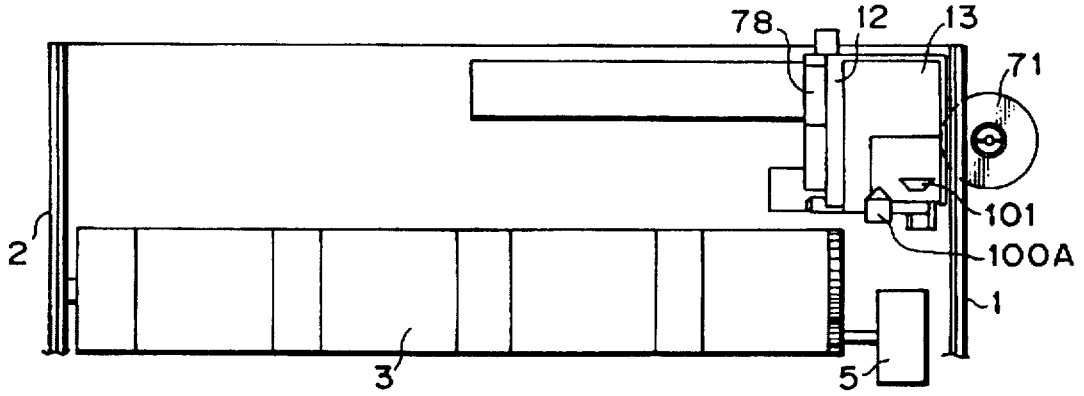
Figure 4C:
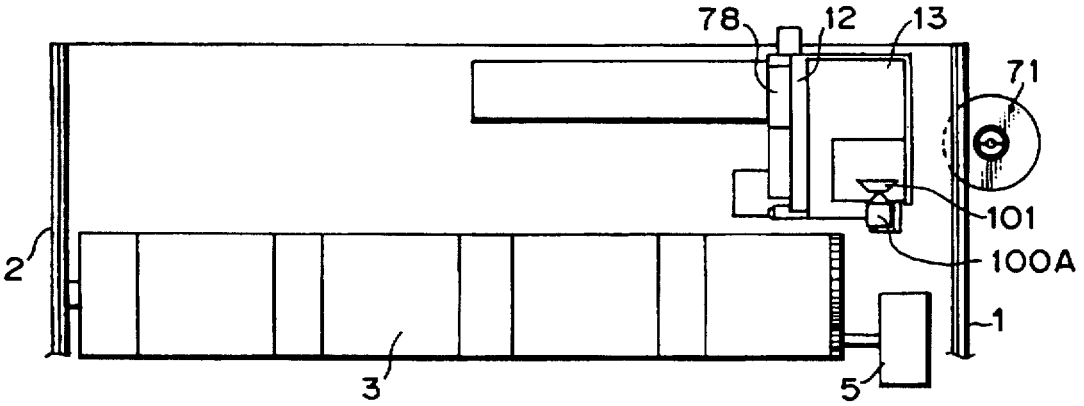

FIG. 4A to FIG. 4C are views which illustratively explain a fifth embodiment of the present invention. In this embodiment, a process of driving a carriage 12 is different from the aforementioned first embodiment.

Specifically, in this embodiment, the carriage 12 is not connected to a belt 65 but a scanning section 78 serving as a scanning type carrier is connected to the belt 65 while its displacement is rotatably and slidably guided by a guide shaft 11. As shown in FIG. 4A and FIG. 4B, when the scanning section 78 comes near to the carriage 12 held at the standby position by a predetermined distance, the scanning section 78 and the carriage 12 are connected to each other and integrated with each other. As a slider 102 comes in slidable contact with a paper retaining plate 103, a distance away from a recording paper sheet 9 is restricted and turning of the carriage 12 integrated with the scanning section 78 about the guide shaft 11 in the anticlockwise direction as seen in FIG. 2 is restricted in the same manner as the first embodiment.

As shown in FIG. 4C, while the carriage 12 is displaced from the standby position to reach the recording/scanning range, a projection 101 of the carriage 12 rides on a sensor 100A, causing the weight of the carriage 12 having a cartridge mounted thereon and the scanning section 78 to be detected. Thus, a quantity of remaining ink can be detected based on the detected weight in the same manner as the first embodiment.

A recording operation is performed for the recording paper sheet 9 by scanning the carriage 12 together with the scanning section 78 within the recording/scanning range.

Thereafter, the carriage 12 is displaced together with the scanning section 78 to the original standby position, and after the carriage 12 is held at the standby position, the scanning section 78 is displaced in the leftward direction so as to be parted away from the carriage 12 until it is disengaged from the connected state.

When the scanning section 78 is connected to and disconnected from the carriage 12, a gripper 62 molded of a synthetic resin and fitting shafts 59 and 63 function. A concrete mechanism for connecting to and disconnecting from the carriage 12 will be explained in another embodiment to be described later.

(Sixth Embodiment)

Figure 5A:
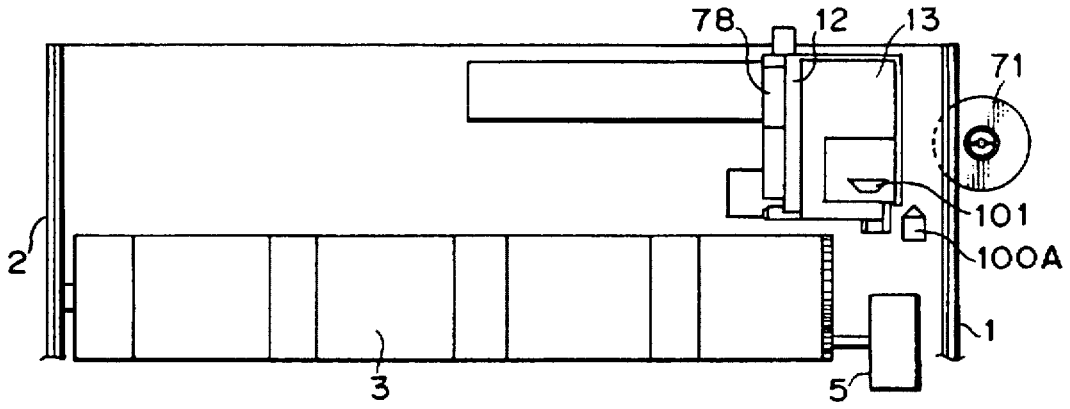
FIG. 5A to FIG. 5C are front views which show essential parts of a sixth embodiment of the present invention, respectively.
Figure 5B:
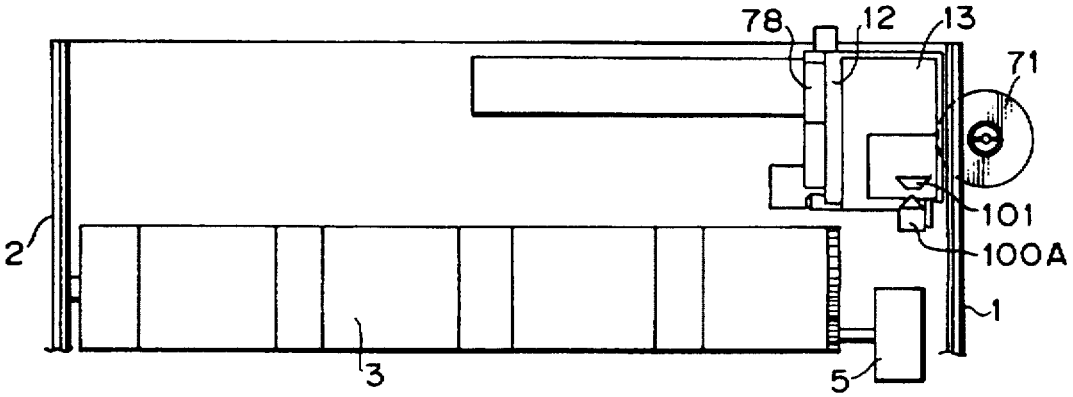
Figure 5C:
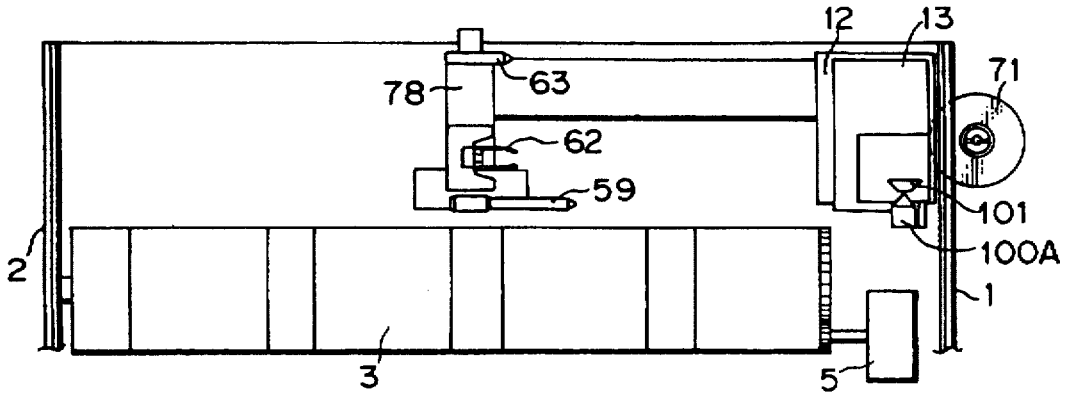

FIG. 5A to FIG. 5C are views which illustratively explain a sixth embodiment of the present invention. In this embodiment, the position where a sensor 100A is disposed is different from the fifth embodiment as mentioned above.

Specifically, the sensor 100A is disposed at the standby position of the carriage 12, and the scanning section 78 and the carriage 12 are released from the connected state at the standby position. When the carriage 12 is rotated about the guide shaft 11 in the anticlockwise direction as seen in FIG. 2, the projection 101 rides on the sensor 100A as shown in FIG. 5C so that the weight of the carriage 12 having a cartridge mounted thereon is detected by the sensor 100A. Therefore, the sensor 100A detects the weight of the carriage 12 separated from the scanning section 78. Thus, it is possible to exactly detect the weight of the carriage 12 by the extent that it is not affected by the scanning section 78.

Rotation of the carriage 12 about the guide shaft 11 in the anticlockwise direction as seen in FIG. 2 is restricted by allowing the projection 101 to ride on the sensor 100A so that the carriage 12 is held at the standby position.

Thereafter, when the scanning section 78 is connected to the carriage 12, the carriage 12 is rotated about the guide shaft 11 in the clockwise direction as seen in FIG. 2 so as to allow the carriage 12 to be parted away from the sensor 100A.

(Seventh Embodiment)

Figure 21C:
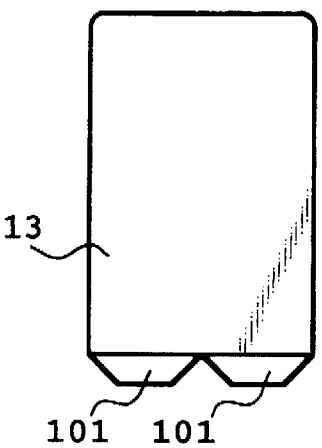
FIG. 21A to FIG. 21C are schematic front views which show functional elements in a first pattern of embodiment for an ink jet recording apparatus of the present invention, respectively.
Figure 21B:
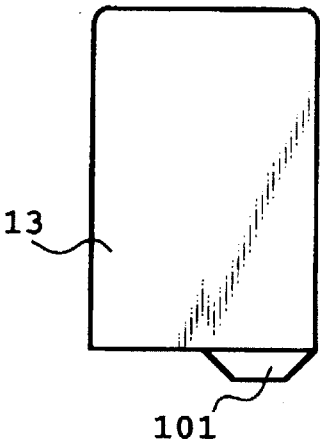
Figure 21A:
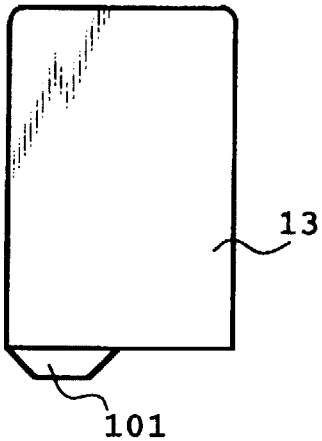

As shown in FIG. 21A to FIG. 21C, various types of ink jet cartridges 13*a* to 13*c* can be mounted on the carriage 12. FIG. 21A to FIG. 21C are a front view of an ink jet cartridge as seen in the arrow-marked direction represented by reference numeral 10 in FIG. 1, respectively, when the ink jet cartridge is mounted on the carriage of the recording apparatus shown in FIG. 1. The ink jet cartridge 13*a* shown in FIG. 21A includes a projection 101 on the left-hand side on the bottom surface thereof, the ink jet cartridge 13*b* shown in FIG. 21B includes a projection 101 on the right-hand side on the bottom surface thereof, and the ink jet cartridge 13*c* shown in FIG. 21C includes a pair of projections 101 not only on the left-hand side but also on the right-hand sides on the bottom surface thereof. Each of the projections 101 is same in size and contour.

Next, a method of discriminating the kind of the ink jet cartridge 13*a* and the state of the same will be explained below with reference to FIG. 22A to FIG. 22C.

Figure 22A:
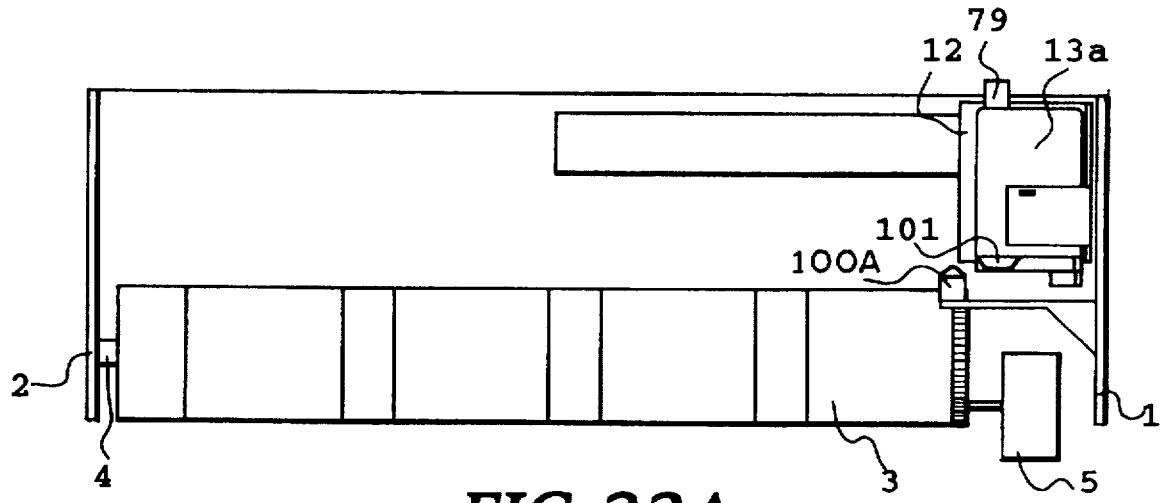
FIG. 22A to FIG. 22C are front views which explain a discriminating method in the case that a functional element shown in FIG. 21A is used, respectively.
Figure 22B:
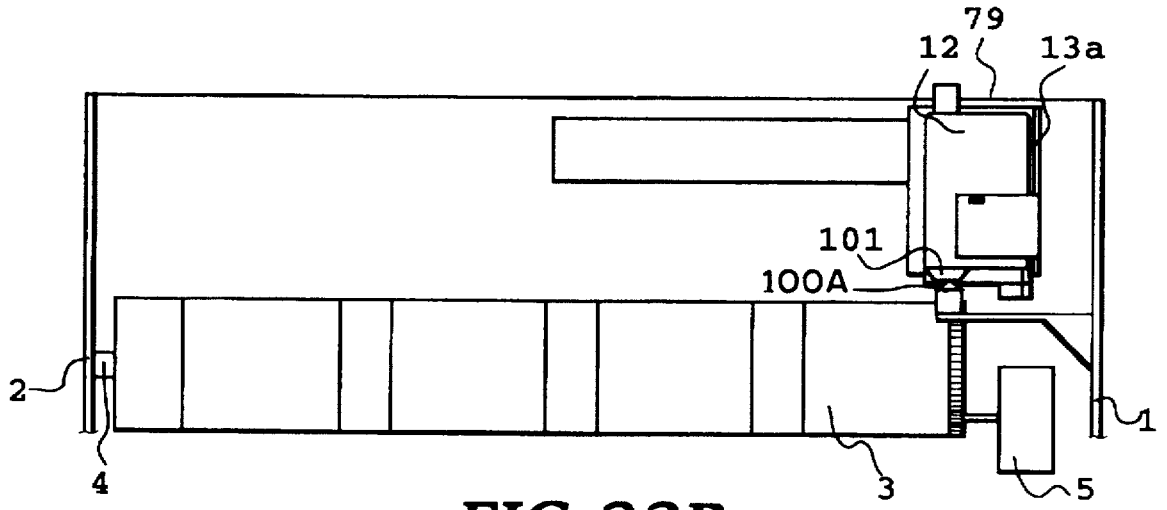

Prior to starting of a printing operation or after completion of the printing operation, the carriage 12 is displaced from the position shown in FIG. 22A to a first stop position shown in FIG. 22B and then is kept immovable. At this time, the projection 101 of the ink jet cartridge 13*a* is caused to ride on a sensor 100A so that the kind of the ink jet cartridge 13*a* and the state of fitting an ink tank to the ink jet cartridge 13*a* are detected by the sensor 100A, and detection signals are transmitted to a determining means (not shown).

Figure 22C:
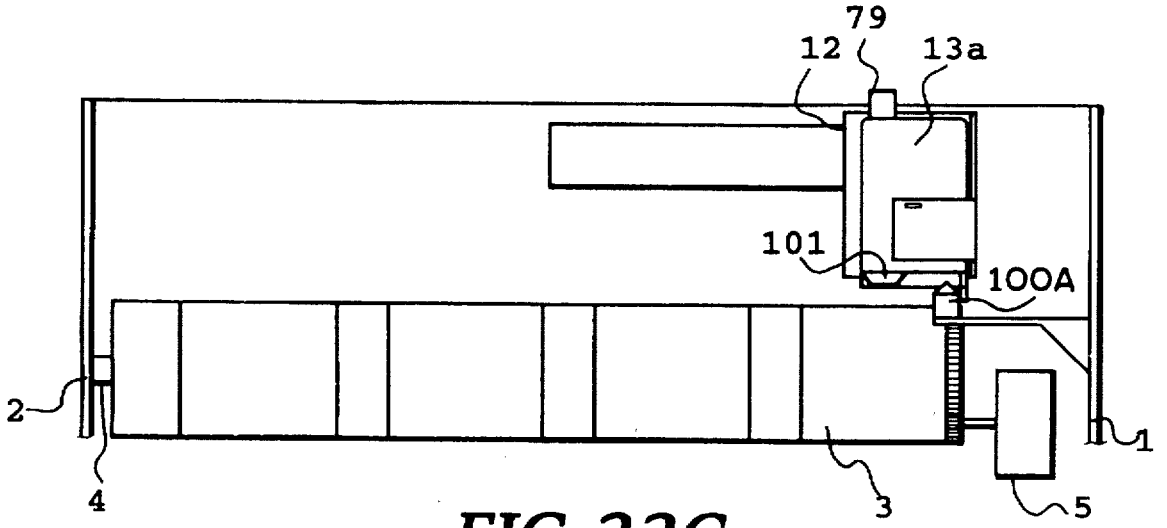

Next, the carriage 12 is displaced to a second stop position shown in FIG. 22C and then is kept immovable. At this time, since the projection 101 of the ink jet cartridge 13*a* does not come in contact with the sensor 100A so that any detection signal of the sensor 100A is not transmitted to the determining means (not shown).

In such manner, the presence and absence of the ink jet cartridge 13*a* and the kind of the ink jet cartridge 13*a* are discriminated by the sensor 100A. Namely, if the ink jet cartridge 13*a* is a black ink jet cartridge, this can be discriminated by the sensor 100A.

Next, a method of discriminating the kind of the ink jet cartridge 13*b* and the state of the same will be explained below with reference to FIG. 23A to FIG. 23C.

Figure 23A:
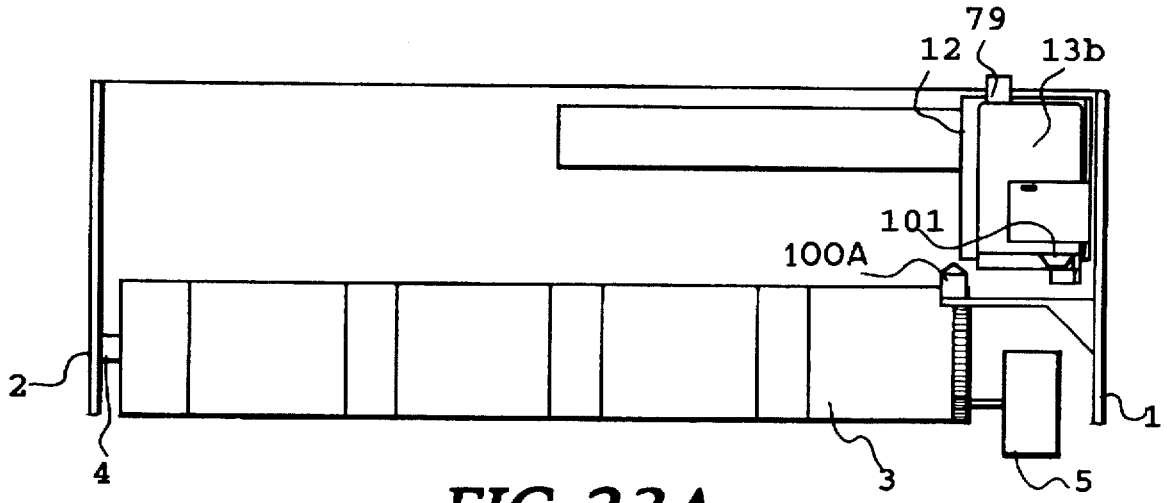
FIG. 23A to FIG. 23C are front views which explain a discriminating method in the case that a functional element shown in FIG. 21B is used, respectively.
Figure 23B:
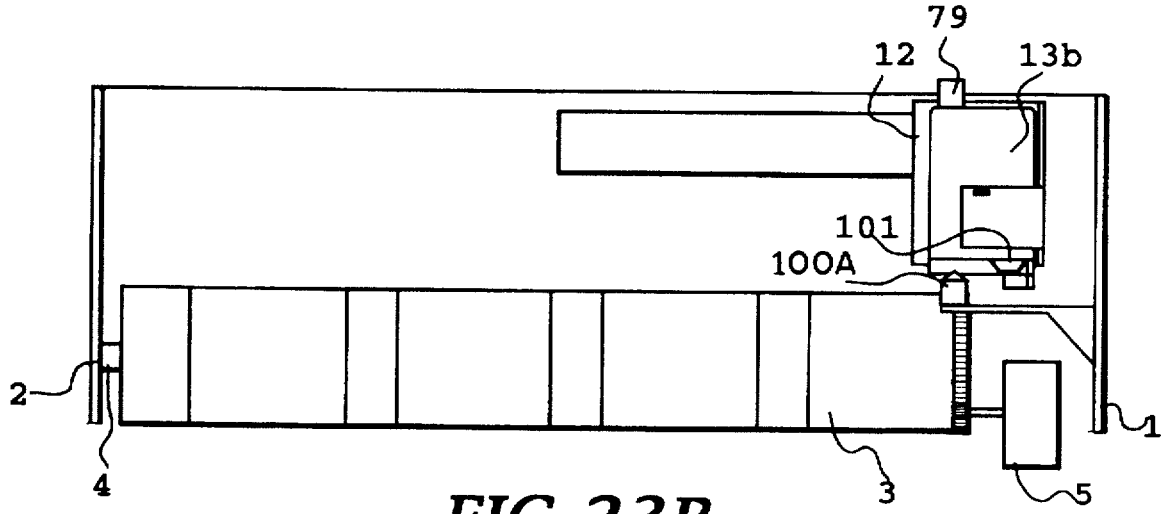

Prior to starting of a printing operation or after completion of the printing operation, the carriage 12 is displaced from the position shown in FIG. 23A to a first stop position shown in FIG. 23B and then is kept immovable. However, the projection 101 of the ink jet cartridge 13*b* does not come in contact with the sensor 100A.

Figure 23C:
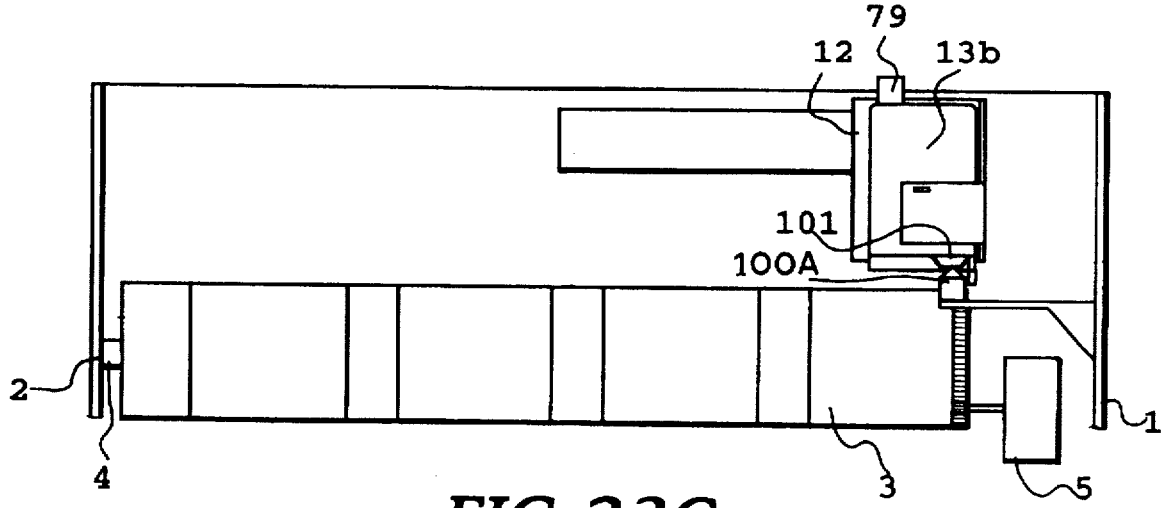

Next, the carriage 12 is displaced to a second stop position shown in FIG. 23C and then is kept immovable. At this time, the projection 101 is caused to ride on the sensor 100A so that the kind of the ink jet cartridge 13*b* and the state of fitting an ink tank to the ink jet cartridge 13*b* are detected by the sensor 100A, and detection signals are transmitted to the determining means (not shown).

In such manner, the presence and absence of the ink jet cartridge 13*b* and the kind of the same are discriminated by the sensor 100A. Namely, if the ink jet cartridge 13*b* is a color ink jet cartridge, this can be discriminated by the sensor 100A.

Figure 24A:
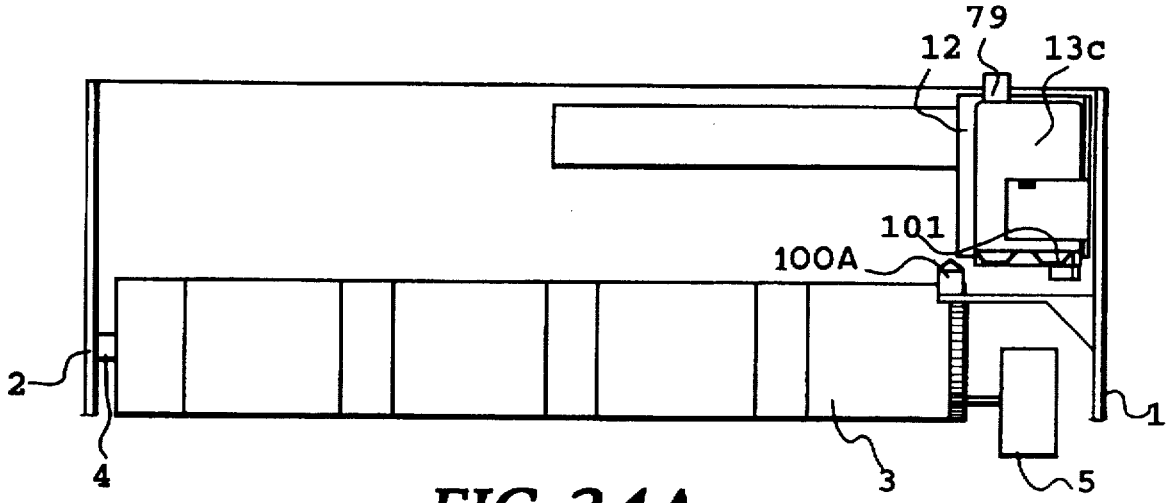
FIG. 24A to FIG. 24C are front views which explain a discriminating method in the case that a functional element shown in FIG. 21C is used, respectively.

Next, a method of discriminating the kind of the ink jet cartridge 13*c* and the state of the same will be explained below with reference to FIG. 24A to FIG. 24C.

Figure 24B:
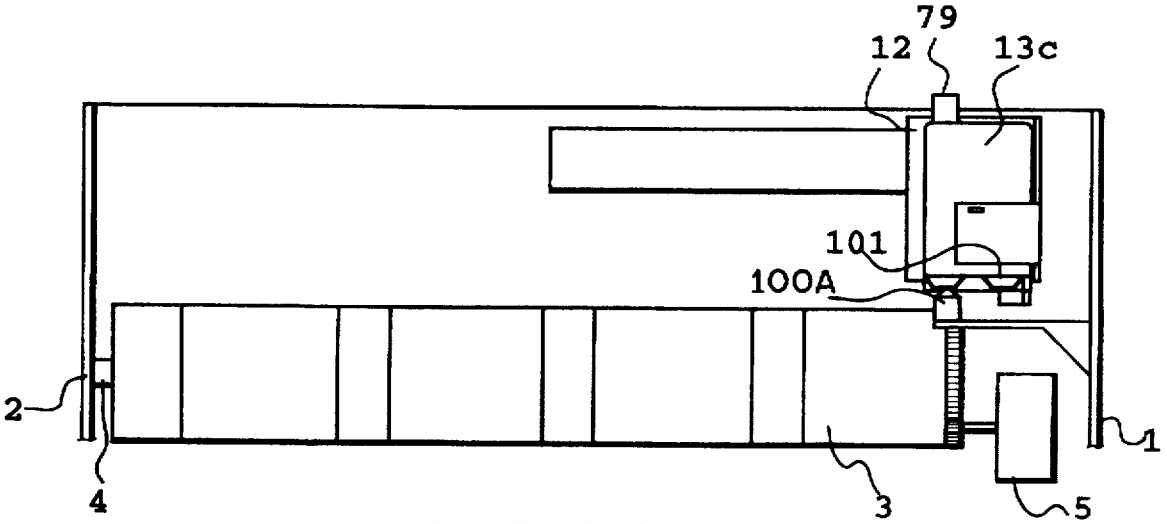
Figure 24C:
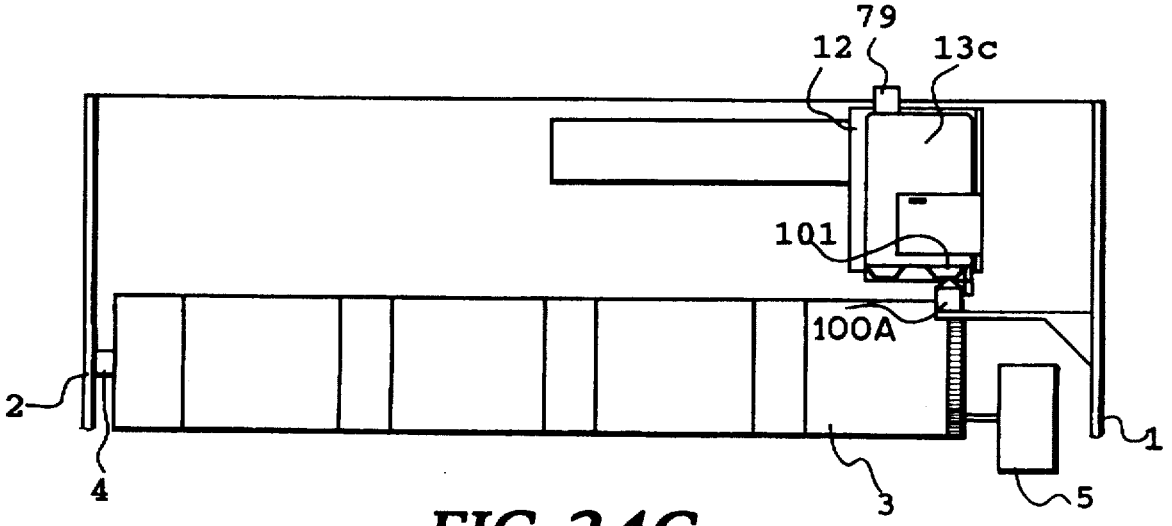

Since the ink jet cartridge 13*c* includes a pair of projections 101, when the carriage 12 is displaced to a first stop position shown in FIG. 24B and a second stop position shown in FIG. 24C and then is kept immovable, each projection 101 is caused to ride on the sensor 100A. Thus, detection signals are transmitted from both the stop positions to the determining means (not shown). As a result, the presence and absence of the ink jet cartridge 13*c* and the kind of the same are discriminated by the sensor 100A. Namely, if the ink jet cartridge 13*c* is an ink jet cartridge of the type including black ink and color ink, this can be discriminated by the sensor 100A.

In such manner, when the position of the projection 101 and the number of the projections 101 change depending on the kind of the ink jet cartridge so that the carriage 12 is caused to stop at the position corresponding to the projection 101, the kind of an ink jet cartridge mounted on the carriage 12 and the state of fitting an ink tank to the cartridge 12 can be determined by the determining means (not shown) based Qn the combination of the stop position of the carriage 12 with the detection signals from the sensor 100A.

(Eighth Embodiment)

A method of discriminating a functional element in accordance with the seventh embodiment has been explained while the functional element is exemplified by an ink jet cartridge. Even when other element such as a scanner or the like is taken as an object to be discriminated, discrimination can be made in the same manner as mentioned above.

Here, in the case that each functional element is discriminated using a scanner in addition to two kinds of functional elements of a black ink jet cartridge and a color ink jet cartridge, examples of combinations made among signals from the sensor 100A are shown in Table 2.

TABLE 2

| | FIRST STOP POSITION | SECOND STOP POSITION | JUDGEMENT |
|---|---|---|---|
| SIGNALS FROM SENSOR 100 A | ON | OFF | A |
| | ON | ON | B |
| | OFF | ON | C |
| | OFF | OFF | D |

The kind of a functional element mounted on the carriage 12 and the state of the same are discriminated from Table 2 in the following manner. Specifically, as shown in Table 2, the case that e.g., a black ink cartridge is mounted on the carriage 12 and a printing operation can be performed is displayed as judgement A, the case that a scanner is mounted on the carriage 12 is displayed as judgement B, the case that a color ink cartridge is mounted on the carriage 12 and an ink tank is fitted to the cartridge is displayed as judgement C, and the case that a black ink cartridge is mounted on the carriage 12 but a small quantity of ink is received in an ink tank or a color ink cartridge is mounted on the carriage 12 but any ink tank is not fitted to the cartridge is displayed as judgement D.

It should be noted that displaying of each judgement can be performed using the displaying section 112 in the controlling system shown in FIG. 3.

In such manner, it is possible to discriminate three functional elements mounted on the carriage 12 and seize the state of each functional element by disposing a single or plural projections 101 at various positions and allowing the carriage 12 to be kept immovable at two stop positions.

Figure 25A:
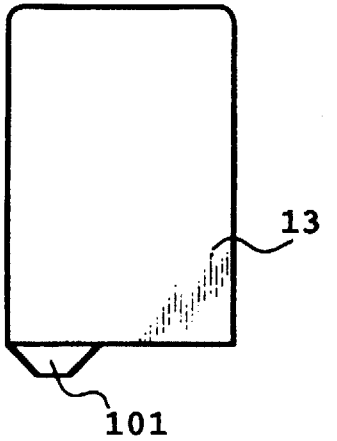
FIG. 25A to FIG. 25C are schematic front views which show functional elements in other pattern of embodiment for the ink jet recording apparatus of the present invention, respectively.
Figure 25B:
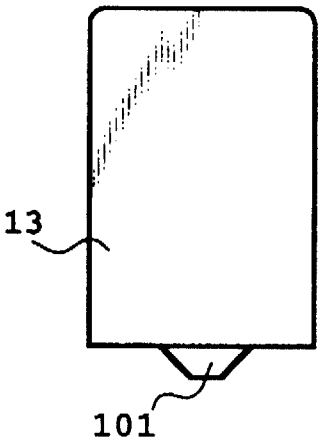
Figure 25C:
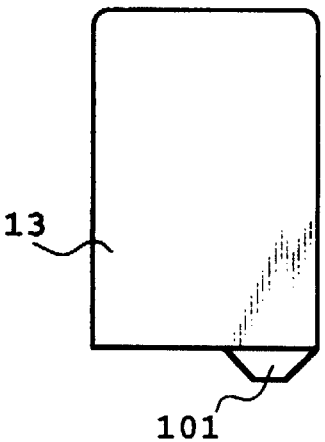

FIG. 25A to FIG. 25C show the structure of a functional element which can be mounted on the ink jet recording apparatus of the present invention, respectively. Each figure is a schematic front view of the functional element, and the position of the projection 101 as seen in the sliding direction of the carriage is located at the left-hand side (FIG. 25A), at the middle (FIG. 25B) and at the right-hand side (FIG. 25C). To activate the sensor 100A, the carriage 12 stops at three positions corresponding to the projection 101 shown in FIG. 25A to FIG. 25C, and discrimination is made with respect to the kind and the state of functional element mounted on the carriage 12 based on the stop position of the carriage 12 in response to an output signal from the sensor 100A. Other structure and advantageous effect are entirely same as those in the seventh embodiment.

(Ninth Embodiment)

A ninth embodiment of the present invention will be explained below with reference to FIG. 6 to FIG. 10 and FIG. 12.

Figure 6:
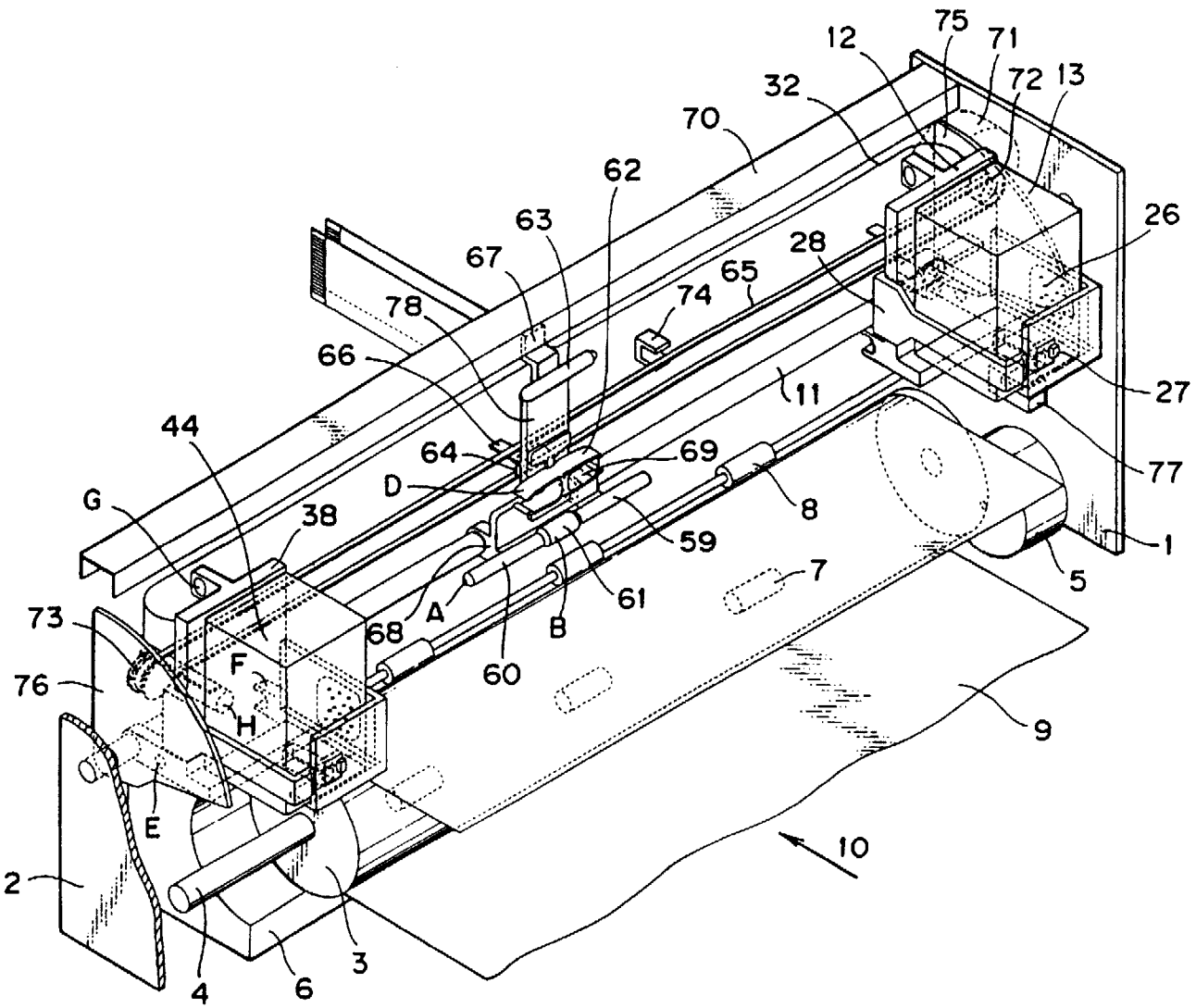
FIG. 6 is a perspective view showing the whole structure of a ninth embodiment of the present invention.
Figure 7:
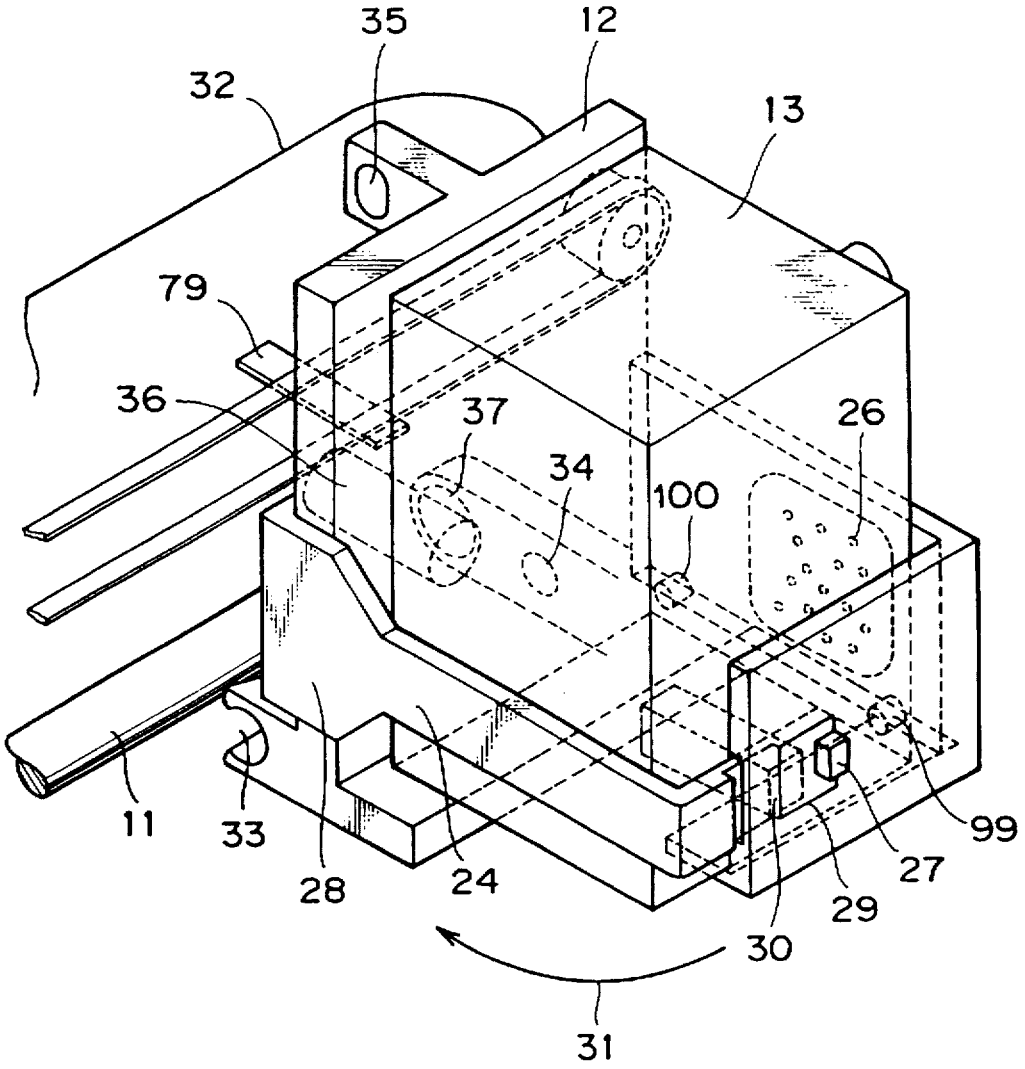
FIG. 7 is a perspective view of a black ink carriage shown in FIG. 6.
Figure 8:
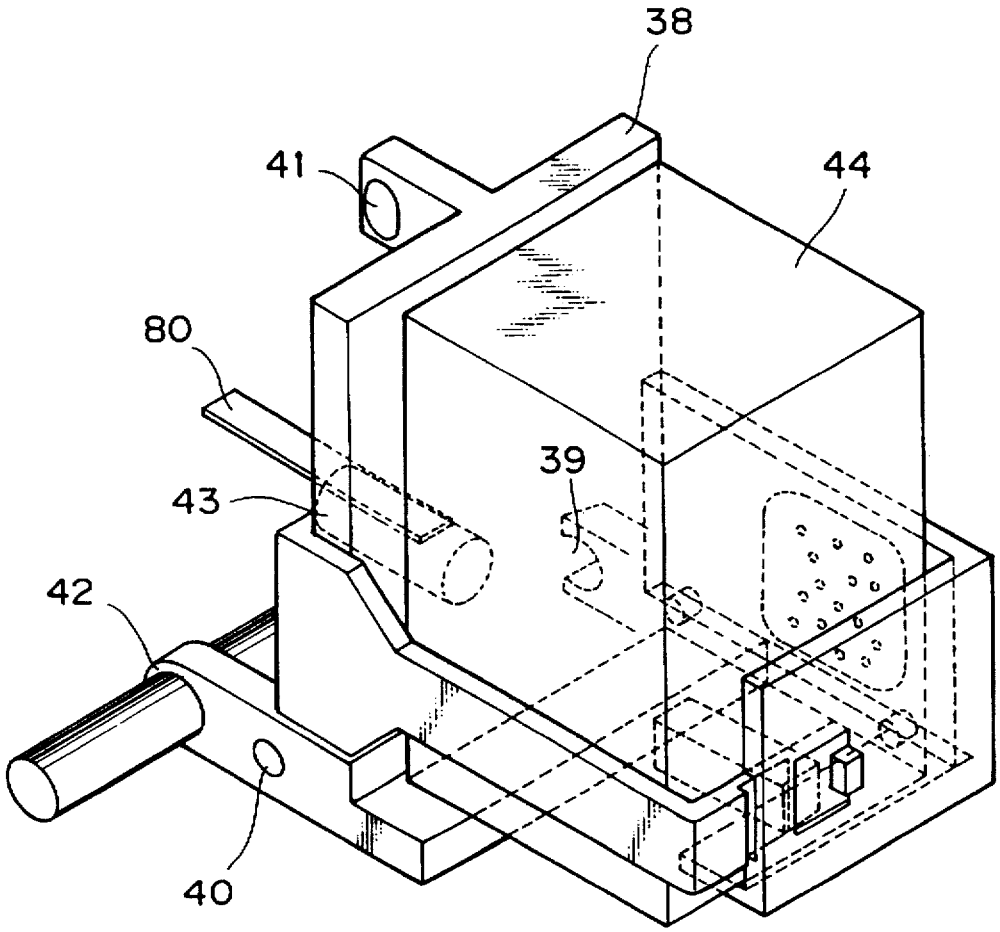
FIG. 8 is a perspective view of a color ink carriage shown in FIG. 6.

This embodiment is an example wherein the present invention is applied to an ink jet recording apparatus. In the fifth and sixth embodiments as mentioned above, one carriage 12 is connected to and disconnected from the scanning section 78. On the contrary, in this embodiment, two carriages 12 and 38 are connected to and disconnected from the scanning section 78. In this embodiment and in a tenth embodiment to be described later, the same sensor 100A as that in the aforementioned embodiments is disposed but repeated description on the sensor 100 is herein omitted. FIG. 6 is the whole perspective view which shows this embodiment.

Reference numeral 1 denotes a right-hand side plate, and reference numeral 2 denotes a left-hand side plate. Reference numeral 3 denotes a platen roller molded of a rubber or a similar elastic material. Reference numeral 4 denotes a platen roller shaft which is formed along the center line of the platen roller 3. The left-hand end of the platen roller shaft 4 is supported by the left-hand side plate 2, while the right-hand end of the platen roller shaft 4 is supported by the right-hand side plate 1. Reference numeral 5 denotes a paper feeding motor which is supported by the right-hand side plate 1 to rotate the platen roller shaft 4 via a train of gears (not shown). Reference numeral 6 denotes a paper guide which is arranged along the peripheral surface of the platen roller 3. Reference numerals 7 and 8 denote pinch rollers which are urged against the surface of the platen roller 3 by springs (not shown) with a predetermined intensity of pressure. A recording paper sheet 9 serving as a medium to be conveyed is supplied in the arrow-marked direction represented by reference numeral 10 and it is inserted into the gap between the platen roller 3 and the paper guide 6 so that it is conveyed in the U-shaped contour while it is clamped between the pinch rollers 7 and 8 and the platen roller 3. Reference numeral 11 denotes a guide shaft having a diameter of 10 mm and serving as a guide mechanism. The opposite ends of the guide shaft 11 are supported by the left-hand side plate 2 and the right-hand side plate 2.

Reference numeral 12 denotes a black ink carriage serving as a carriage having a functional element mounted thereon. The black ink carriage 12 will be explained in more detail with reference to FIG. 7. A black ink cartridge 13 is mounted on the black ink carriage 12. Reference numeral 24 denotes a cartridge hook which serves to thrust the cartridge 13 against a contact portion 26 located in the carriage 12. When a button 27 is pushed, an engagement portion 30 is disengaged from a square hole 29 formed on the carriage 12, and hook 24 is openably turned about a fulcrum 28 in the arrow-marked direction represented by reference numeral 31. While the hook 24 is kept opened, a black ink cartridge 13 is inserted into the carriage 12 from the above, and when the hook 24 is closed, the cartridge 13 is thrusted against the contact portion 26 so that it is kept immovable. Pins 99 and 100 are projected from the carriage 12, and they are fitted into locating holes on an aluminum plate (to be described later) attached to the cartridge 13. The cartridge 13 is properly positioned by abutting against the root portions of the pins 99 and 100. Reference numeral 32 denoted a flexible cable which follows the movement of the carriage 12 in the curved state. The contact portion 26 is formed at one end of the flexible cable 32. The contact portion 26 is arranged inside the carriage 12 to give an ink ejection signal as a functional element driving signal to the cartridge 13 from a base plate (not shown). The carriage 12 includes fitting holes 33, 34 and 35 to be integrated with a scanning section 78 serving as a carrier to be described later, and moreover, includes a grip portion 36. The hole 35 is an elongated hole extending in the vertical direction, and the grip portion 36 is projected outside the wall portion of the carriage 12. Reference numeral 37 denotes a hole which is formed on the carriage 12 so as to allow the guide shaft 11 to extend therethrough. The hole 37 is dimensioned to have an inner diameter of 10.2 mm so as not to cause a frictional load when the carriage 12 is integrated with the scanning section 78. When the guide shaft 11 is fitted through the hole 37, the carriage 12 is swingably engaged with the guide shaft 11 serving as a guide mechanism. In addition, the carriage 12 is held at the position as a first standby location above a cap 77 (see FIG. 6) to be described later in such a manner as to restrict the swinging movement in the downward direction. Reference numeral 79 denotes a sensor shielding plate for the black carriage which shields a light permeable type home position sensor 74 to be described later.

In FIG. 6, reference numeral 38 denotes a color ink carriage on which a color ink cartridge 44 is mounted. The carriage 38 will be explained below with reference to FIG. 8. Since the carriage 38 is similar to the black ink carriage 12 shown in FIG. 7, only different points will be explained below. Reference numerals 39, 40 and 41 denote fitting holes to be fitted to a scanning section 78 to be described later. The positions of the fitting holes 39 and 40 are reversed relative to the fitting holes 33 and 34 on the black ink carriage 12 as seen in the horizontal direction. The hole 41 is an elongated hole extending in the vertical direction. Reference numeral 43 denotes a grip portion which is projected outside the wall portion of the carriage 38. Reference numeral 80 denotes a sensor shielding plate for the color carriage. The carriage 38 has a hole 42 similar to the hole 37 of the carriage 12, and when the guide shaft 11 is fitted through the hole 42, the carriage 38 is swingably engaged with the guide shaft 11 serving as a guide mechanism. A cap similar to the cap 77 disposed at the position facing to the carriage 38 shown in FIG. 6 has a first standby location at the upper surface thereof in such a manner as to restrict the swinging movement of the carriage 38 in the downward direction.

The black ink cartridge 13 includes an ink tank for receiving black ink and an ink jet recording head serving as a functional element for ejecting black ink therefrom. The ink tank includes a sponge (not shown) and contains ink. An ink capacity is equal to about 700 sheets provided that characters are printed on, e.g., A4-sized recording paper sheet 9. Position locating holes for the carriage 12 are formed on a heat radiating aluminum plate (not shown) provided on the cartridge 13. In addition, a base plate (not shown) including contacts corresponding to the contact portion 26 is fixed in parallel with the aluminum plate.

The color ink cartridge 44 includes a black ink tank, a color ink tank and a color ink jet recording head serving as a functional element, and in contrast with the tank 13 for the black ink cartridge, these ink tanks can be exchanged with another ones by removing them from the color recording head. The structure in the ink tank is such that it includes a sponge in the same manner as the black ink cartridge 13. Yellow, magenta and cyan ink receiving ranges are formed in the interior of the color ink tank so that these inks are supplied to the ink jet recording head via ink supply ports from sponges received in these receiving ranges.

Next, the scanning section 78 serving as a scanning type carrier will be explained below with reference to FIG. 6. In FIG. 6, the guide shaft 11 is fitted through left-hand and right-hand bearings 68 and 69 of the scanning section 78. An upper guide 67 slidably moves along a rail 70. Reference numeral 65 denotes a belt which is fixed to a belt fastener 64 serving as a driving force receiving portion located at the intermediate position as seen in the leftward/rightward direction of the scanning section 78. One side of the belt 65 is extended around a motor pulley 72, while the other side of the belt 65 is extended around a tension pulley 73 biased in such a direction that the belt is stretched by the action of a spring (not shown). The scanning section 78 is displaced in the main scanning direction by driving a carrier motor 71. Reference numeral 66 denotes a sensor shielding plate. By shielding a light beam passage for a light permeable type home position sensor 74 with the sensor shielding plate 66, an output signal for controlling the position of the scanning section 78 is generated.

Figure 12:
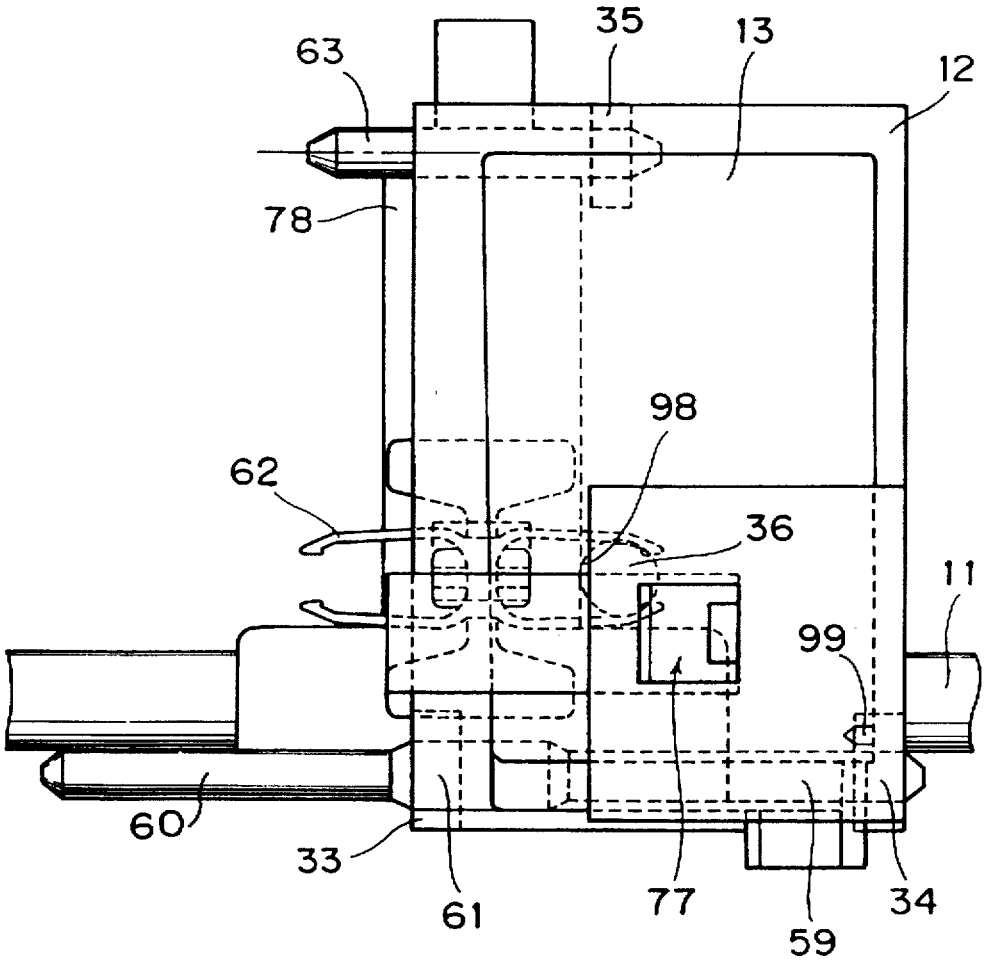
FIG. 12 is a front view which explains the connected state of the black ink carriage and the carrier shown in FIG. 6.

Reference numeral 62 denotes two pair of grippers molded of a synthetic resin which are fixed onto the scanning section 78 symmetrically as seen in the leftward/rightward direction. The grippers 62 grip the grip portions 36 and 43 on the black ink carriages 12 and the color ink carriage 38 with bifurcated pawls. FIG. 12 shows that the scanning section 78 is connected to the black ink carriage 12. The grip portion 36 of the carriage 12 abuts against a stopper portion 98 of the scanning section 78 so that the carriage 12 and the scanning section 78 are held in the connected state. Namely, the cartridge 13 is properly located relative to the carriage 12 by allowing the cartridge 13 to abut the root portions of the position locating pins 99 and 100, and the carriage 12 is properly located relative to the scanning section 78 by abutting the stopper 98. With this construction, when the scanning section 78 is scanned, recording can be achieved at the exact position on the paper sheet 9. While the scanning section 78 grips the grip portion 36 of the black ink carriage 12, fitting shafts 59, 61 and 63 of the scanning section 78 are fitted into the fitting holes 34, 33 and 35 so that the scanning section 78 and the carriage 12 can integrally be scanned. On the other hand, when the color ink carriage 38 and the scanning section 78 are integrated with each other, the gripper 62 grips the grip portion 43 and the fitting shafts 60, 61 and 63 of the scanning section 78 are fitted into the fitting hole 40, 39 and 41 of the color ink carriage 38 so that the scanning portion 78 and the carriage 38 can integrally be scanned in the same manner as mentioned above. When the carriages 12 and 38 located on the cap as first and second standby locations are connected to the scanning section 78, the gripper 62 and the fitting shafts 59, 61 and 63 constitutes an engagement mechanism for restricting the swinging movement of the carriages 12 and 38.

Reference numeral 75 denotes a black gripper molded of a synthetic resin which serves to restrictively hold the black ink carriage 12 at the position shown in FIG. 6, and reference numeral 76 denotes a color gripper which serves to restrictively hold the color ink carriage 38 at the position shown in FIG. 6. The black gripper 75 and the color gripper 76 resides in the mirror image relationship in contour, but since they operate in the same manner, description will be made below only with respect to the black gripper 75.

Figure 9A:
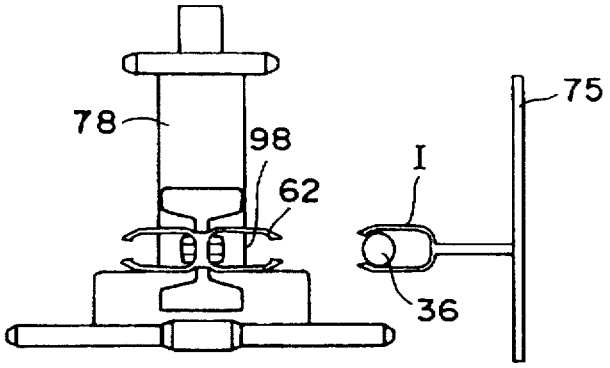
FIG. 9A to FIG. 9D are front views of essential components which explain a connecting operation for connecting the black ink carriage to a carrier shown in FIG. 6, respectively.
Figure 9B:
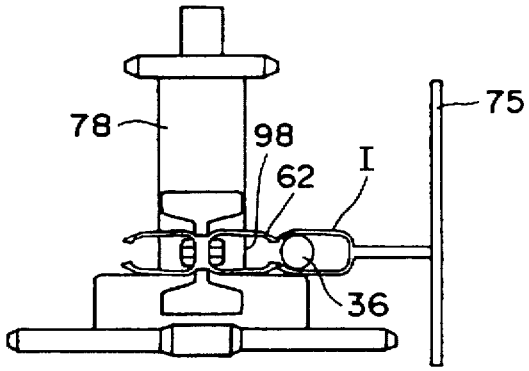
Figure 9C:
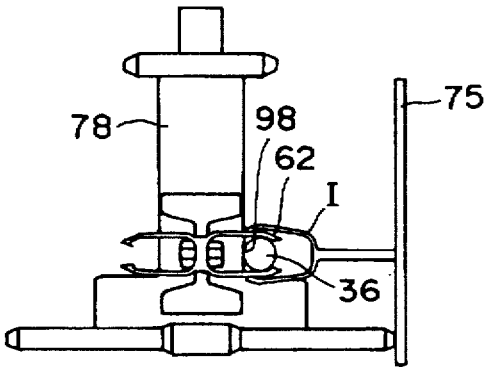
Figure 9D:
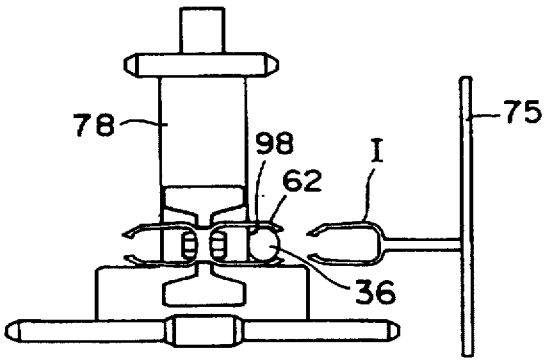

FIG. 9A to FIG. 9D are front views which show the relationship between the grip portion 36, the gripper 62 and the black gripper 75 of the black ink carriage 12, and illustration of the carriage 12 is herein omitted. FIG. 9A shows that the black gripper 75 restrictively holds the carriage 12. Since the bifurcated pawls I of the black gripper 75 seizes the grip portion 36, they are deformed as if they are opened in the outward direction. FIG. 9B shows the state that the scanning section 78 comes near to the carriage 12, and the bifurcated pawls of the gripper 62 are about to enter the inside the opened pawls I of the black gripper 75. FIG. 9C shows the sate that the scanning section 78 approaches, and the gripper 62 grips the grip portion 36 and the pawls I of the black gripper 75 are further expanded. Thereafter, as shown in FIG. 9D, when the scanning section 78 moves in the reverse direction, the carriage 12 assumes the state that it performs scanning together with the scanning section 78. Thereafter, when the scanning section 78 is displaced again in the rightward direction, the carriage 12 is displaced toward the black gripper 75 from the scanning section 78 reversely to the aforementioned step. In such manner, receipt and delivery of the carriage 12 are achieved every time the scanning section 78 comes near to the black gripper 75.

In FIG. 6, reference numeral 77 denotes a cap which protects the recording head from drying by capping the recording head of the black ink cartridge 13. A cap (not shown) is disposed also for the color ink cartridge 44 in the same manner as mentioned above. When the black ink carriage 12 is located at the capping portion while it is restrictively held by the black gripper 75, the cap 77 comes in contact with a head surface of the recording head of the black ink cartridge 13 by means such as a cam or the like (not shown), and thereafter, when the carriage 12 is parted away from the black gripper 75 while it is released from the restrictively held state, the cap 77 is retracted.

Next, operation of the ink jet recording apparatus will be described below with reference to FIG. 6 and FIG. 10.

Before a power source is turned on, the scanning section 78 is kept stationary at the position coincident with 50 mm leftward of the position where a light beam passage of the home position sensor 74 is shaded by the shading plate 66, and the black ink cartridge 12 and the color ink cartridge 38 are located at the corresponding capping position so that their cartridges 13 and 44 are capped.

When a power source is turned on, the scanning section 78 is displaced toward the black ink carriage 12 side in the rightward direction by a distance of 100 mm (step S1, step S2). At this time, the number of times when the light beam passage of the home position sensor 74 is shielded is determined, and when it is found that the foregoing number is one, the scanning section 78 is reversed to be displaced in the leftward direction (step S5), and after the light beam passage of the sensor 74 is shielded again, the scanning section 78 is displaced by a distance of 50 mm and stops at the position (initial position) corresponding to the foregoing distance (step S6). On the other hand, if the light beam passage of the sensor 74 is shielded twice, it is determined that the black ink carriage 12 or the color ink carriage 38 is connected to the scanning section 78, and moreover, the ON/OFF timing of a detection signal from the sensor 74 is determined. While the scanning section 78 and the carriage 12 are connected to each other, the shielding plate 66 and the shielding plate 79 have a gap of 20 mm therebetween, and while the scanning section 78 and the carriage 38 are connected to each other, the shielding plate 66 and the shielding plate 80 have a gap of 6 mm therebetween. Therefore, it can be determined depending on the timing of shielding the light beam passage of the sensor 74 which one of the carriages 12 and 38 is connected to the scanning section 78.

When the black ink carriage 12 (that is called Bk carriage or a black carriage) is connected to the scanning section 78, after the shielding plate 66 passes past the sensor 74, the black ink carriage 12 is displaced to the cap position (step S4, step S11), and after the carriage 12 is restrictively held by the black gripper 75, the scanning section 78 is reversed to be displaced in the leftward direction (step S5), and after the light beam passage of the sensor 74 is shielded again, the scanning section 78 is displaced to the initial position where it is kept immovable (step S6). On the other hand, when the color ink carriage 38 is connected to the scanning section 78, after the shielding plate 66 passes past the sensor 74, the scanning section 78 is displaced in the rightward direction by a distance of 50 mm and then reversed to be displaced in the leftward direction (step S9), and the color ink carriage 38 (that is also called color carriage) is displaced to the capping position (step S10), and after the color carriage 38 is restrictively held by the color gripper 73, the scanning section 78 is reversed again (step S5) and is kept immovable at the initial position (step S6).

While either of the carriages 12 and 38 is not connected to the scanning section 78, only the scanning section 78 is displaced to be kept immovable at the initial position. When the carriages 12 and 38 are connected to the scanning section 78 due to unexpected situation while the power source is turned off, the carriages 12 and 38 are brought to the corresponding capping position where they are restrictively held, and thereafter, only the scanning section 78 is displaced to the initial position to be kept immovable.

When a recording signal is inputted into the ink jet recording apparatus, it is determined whether the recording signal is intended for recording black-colored matters such as texts, ruled lines or the like or it is a color image signal (step S7, S8). In the former case, the scanning section 78 is displaced to the capping position of the black carriage 12 so that it is integrated with the black carriage 12 (step S16). In the latter case, the scanning section 78 is displaced to the capping position of the color carriage 38 so that it is integrated with the color carriage 38 (step S13). At the same time, the cap is retracted from the cartridge 13 or 14 which is used for performing recording (step S17, S14). In the case that recording is performed with the black carriage 12, recording is achieved using 128 nozzles, and when recording is performed by a quantity corresponding to one scanning (step S18), the paper sheet 9 is supplied by a distance corresponding to 128 nozzles (step S19, S23), and subsequently, next scanning is performed (step S18). When recording is completed by a distance corresponding to one page, the paper sheet 9 is discharged (step S10 and S20). If recording is continuously performed, a new paper sheet 9 is supplied (step S24 and S25). If recording is completed, the scanning section 78 is displaced until the black carriage 12 reaches the capping position (step S26), and the black carriage 12 is restrictively held by the black gripper 75, and after the cap 77 is capped (step S27), the scanning section 78 is displaced to the position at the time when the power source is turned off so that it is held immovable (step S28). Thereafter, the power source is turned off (step S29). On the other hand, when recording is performed with the color carriage 38, colors are caused to overlap one above another within the range having a high color image rate while conveying the paper sheet by a distance corresponding to 24 nozzles in order of black, cyan, magenta and yellow, and the range having a black image is recorded using 64 black nozzles while the paper sheet is conveyed at a distance corresponding to 64 black nozzles (step S22).

The scanning section 78 and the carriage 12 and 38 can not easily be separated from each other due to the resiliency of the bifurcated pawls of the gripper 62. However, since it is considered that they are parted away from each other due to user's hand touch or a similar situation, it is monitored whether or not the light beam passage of the sensor 74 is twice shielded at a predetermined timing during a single scanning operation of the scanning section 78. In the case that the light beam passage is just once shielded, it is determined that the scanning section 78 and the carriage 12 or 38 are parted away from each other, and the scanning section 78 is stopped so that the program goes to a relief sequence. In the case that a recording operation is performed with the black carriage 12 directly before the foregoing determination is made, the scanning section 78 is displaced in the rightward direction by a distance of 350 mm. During this displacement, the gripper 62 comes in contact with the grip portion 36 and it thrusts the black carriages 12 as it is so that the latter is displaced in the rightward direction. Thereafter, the grip portion 36 comes in contact with the bifurcated pawls I of the black gripper 75, and the grip portion 36 is gripped by the black gripper 75. When the scanning portion 78 is further displaced in the rightward direction, the pawls of the gripper 62 are received in the inside of the pawls I of the black gripper 75. After the carrier motor 71 is rotated out of order by a quantity corresponding to the extra displacement, rotation of the carrier motor 71 is stopped. Next, the scanning section 78 is revered and displaced together with the black carriage 12 in the leftward direction, and after it passes past the sensor 74, it is stopped at the initial position. At the same time, the platen roller 3 is rotated to discharge the paper sheet 9, and a new paper sheet 9 is supplied to be ready for performing a recording operation again. On the other hand, in the case that a recording operation is performed with the color carriage 38 directly before the aforementioned determination is made, the scanning section 78 is displaced in the leftward direction by a distance of 350 mm. The subsequent stapes are same as those in the relief sequence for the black carriage 12. In this manner, the present embodiment makes it possible to perform a recording operation by carring out the relief sequence automatically even when the scanning section 78 is accidentally parted away from the carriage 12 or 38.

As mentioned above, in this embodiment, a suitable carriage is selected depending on the kind of a recording signal to perform a recording operation. Such selection may be made corresponding to an operation mode of the recording apparatus. In this embodiment, since a head having nozzles each ejecting a different color ink arranged in the vertical direction is used as a recording head for the color ink cartridge 44, a width of the head can be reduced comparing with a head having nozzles arranged in the traverse direction. Consequently, the whole apparatus can be constructed with smaller dimensions.

In this embodiment, since first and second standby locations for holding the carriages 12 and 38 are located on opposite end sides as seen in the scanning direction of the scanning section 78, the carriages 12 and 38 can be engaged with and disengaged from the scanning section 78 merely by allowing the scanning section 78 to scan in one direction or in the other direction. Thus, the structure of the whole apparatus can be simplified and designed with small dimensions.

As is apparent from FIG. 12, while the scanning section 78 and the carriage 12 are connected to each other, the intermediate portion of the scanning section 78 as seen in the leftward/rightward direction is involved in the projected space of the carriage 12 in the perpendicular direction relative to the scanning direction of the scanning section 78, i.e., in the projected space of the carriage 12 as seen in the front/rear direction of the paper surface of FIG. 12. As mentioned above, since the belt fastener 64 (see FIG. 6) serving as a receiving portion of the driving power of the scanning section 78 is located at the intermediate portion of the scanning section 78 as seen in the leftward/rightward direction, it is natural that the belt fastener 64 intervenes in the projected space of the carriage 12. Thus, the distance between the belt fastener 64 for receiving the driving force and the center of gravity of the carriage 12 is shortened, and the moment caused between the belt fastener 64 and the bearings 68 and 69 when the scanning section 78 scans together with the carriage 12 is held to assume a low level. This is advantageous for them to smoothly scan. Since the gripping position of the gripper 62 and the grip portion 36 is located in the projected space of the carriage 12, when the carriage 12 scans together with the scanning section 78, an occurrence of vibrative movement of the carriage 12 is suppressed. This is same when the scanning section 78 and the carriage 38 are connected to each other. Indeed, since the intermediate portion of the scanning section 78 as seen in the leftward/rightward direction is selectively utilized as a space occupied by each of the carriages 12 and 38, the scanning section 78 can be designed in smaller dimensions in the leftward/rightward direction.

When the scanning section 78 is connected to the carriage 12, it is desirable that the positional relationship among the gripper 62 on the scanning section 78 side, the fitting shafts 59, 61 and 63, the grip portion 36 on the carriage 12 side and the fitting holes 34, 33 and 35 is preliminarily determined so as to allow them to be fitted in the following order. First, the fitting shaft 63 is fitted into the fitting hole 35 that is an elongated hole, the carriage 12 is properly located in the front/rear direction of the paper surface of FIG. 12, and thereafter, the fitting shaft 59 and 61 are fitted into the fitting holes 34 and 33 to properly locate the carriage 12 in the upward/downward direction of FIG. 12, and thereafter or at the same time, the gripper 62 is gripps the gripping portion 36. In such manner, it is advantageous for assuring engagement for pulling/releasing of the carriage 12 to properly locate the carriage 12 and restrictively determine the relative positional relationship between the carriage 12 and the scanning section 78 before the gripper 62 gripps the gripping portion 36. This is same with respect to connection of the scanning section 78 to the carriage 38. In FIG. 6, marks A, B, C and D are added to the fitting shafts 60, 61 and 63 and the gripper 62 on the scanning section 78 side and marks E, F, G and H are added to the fitting holes 40, 39 and 41 and the gripper portion 43 on the carriage 38 side, correspondingly.

In this embodiment, ink cartridges 13 and 44 are mounted on the carriages 12 and 38. Alternatively, it is acceptable that the cartridges 13 and 14 or the recording head itself are received and delivered so that they are selectively connected to the scanning section 78 on the assumption that the carriages 12 and 38 are absent. Also in this embodiment, the gripper 62 including the bifurcated pawls molded of a synthetic resin is used as means for connecting the carriages 12 and 38 to the scanning section 78 and as means for restrictively holding the carriages 12 and 38 at the capping position. However, the present invention should not be limited only to this. A process of opening and closing the bifurcated pawls using a solenoid and a process of utilizing an attractive force between a solenoid and a metallic material are employable as practical means.

The functional element should not be limited only to the recording head. For example, an image reading apparatus can be constructed by providing a reading sensor as a functional element. In addition, one of the carriages 12 and 38 may be provided as a carriage exclusively usable for the ink jet recording head, and the other one may be provided as a carriage exclusively usable for the image reading head. The carriages 12 and 38 may be designed with a same structure so that one of them is provided as a spare. Plural image reading heads having resolution of, e.g., 300 dpi, 350 dpi, 600 dpi and 720 dpi may exchangeably be provided as functional elements. Further, recording heads each ejecting a different kind of ink, e.g., a recording head for ejecting sense black ink, a recording head for ejecting yellow ink, magenta ink and cyan ink, recording head for ejecting yellow ink, magenta ink, cyan ink and black ink and a recording head for ejecting light black ink may exchangeably be provided as functional elements. It of course is obvious that various type of heads such as a thermal head or the like can be employed as a recording head. In addition, an auto-changer for selectively displacing plural functional elements may be provided at a location on the end side as seen in the scanning direction of the scanning section 78 so that a functional element displaced to the foregoing location is connected to the scanning element 78 by the auto-changer.

(Tenth Embodiment)

Figure 11:
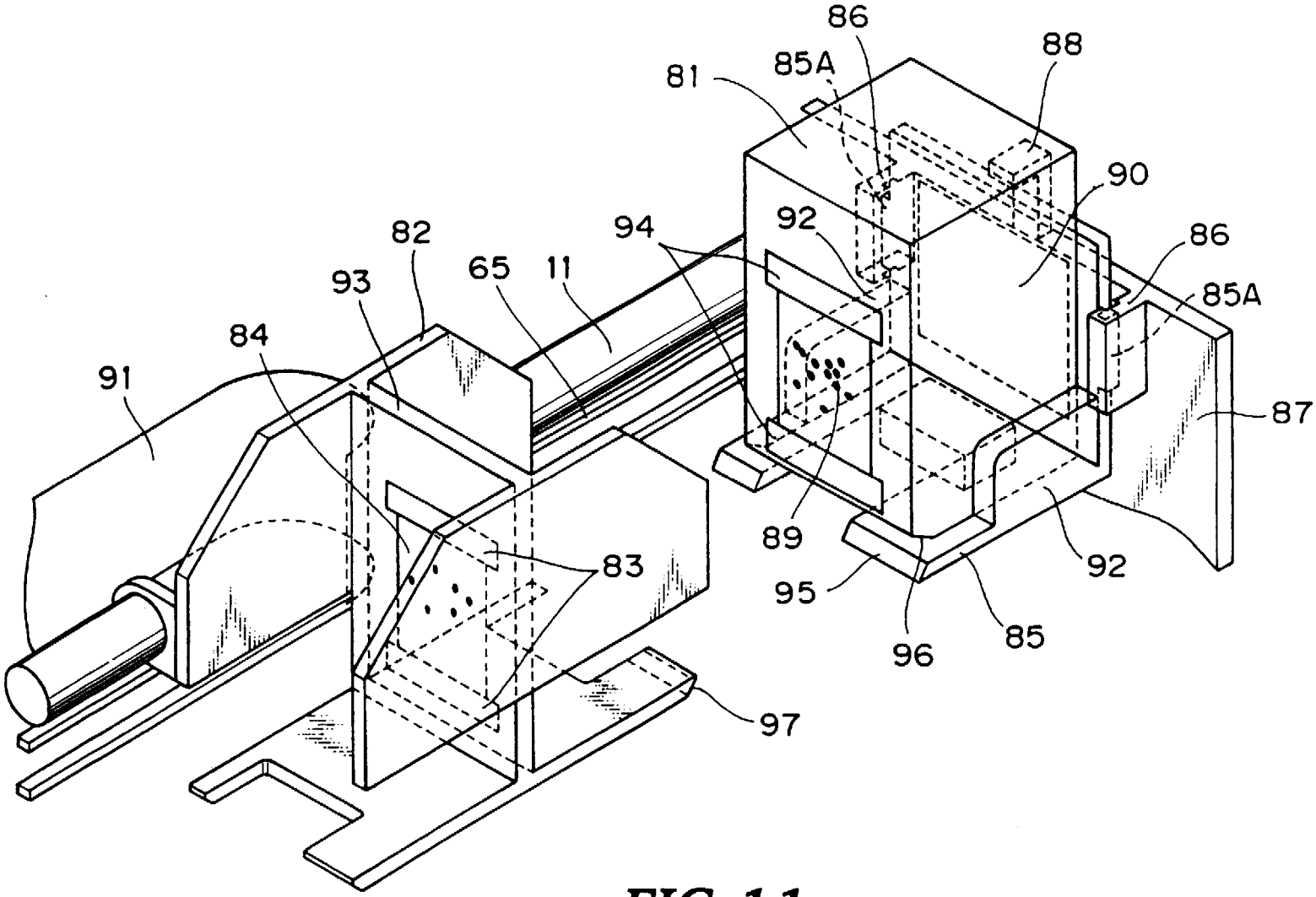
FIG. 11 is a perspective view of essential parts which show a tenth embodiment of the present invention.

In FIG. 11, reference numeral 81 denotes a black ink cartridge which is constructed in the same manner as the black ink cartridge 13 in the precedent ninth embodiment. This cartridge 81 is placed on a cartridge stacker 85. A tapered portion 96 for allowing a scanning section 82 serving as a carrier to come in contact therewith is formed at the lower part of the cartridge 81. A magnet 90 is disposed on the cartridge stacker 85, and a steel plate (not shown) placed on the surface of the black ink cartridge 81 is attracted by the magnet 90. Guides 92 are disposed on the cartridge stacker 85 in such a manner as to hold the cartridge 81 in the clamped state to locate the cartridge 81. Ribs 85A are formed on the opposite ends of the cartridge stacker 85, and the ribs 85A are fitted into grooves 86 formed on a side plate 87. Thus, the cartridge stacker 85 can slidably be displaced along the grooves 86 in the upward/downward direction. The cartridge stacker 85 is biased in the upward direction by biasing means (not shown) and abuts against a stopper 88 projecting from the side plate 87 to be kept immovable. Tapered portions 95 adapted to come in contact with a scanning section 82 to be described later are formed on the stacker 85.

Reference numeral 82 denotes a scanning section serving as a carrier which is supported on the guide shaft 11 and can be scanned by a belt 65 in the axial direction of the guide shaft 11. The scanning section 82 exhibits a plane symmetrical contour with respect to an intermediate wall 93 as a boundary. Reference numeral 84 denotes a contact portion of which contacts are present on the opposite surfaces of the intermediate wall 93. Contacts on the contact portion 84 are located at the positions corresponding to contacts 89 disposed on the side surface of the black ink cartridge 81. When both the contacts on the contact portions come in contact with each other, a recording signal is sent to the black ink cartridge 81 from a flexible cable 91. Reference numeral 83 denotes permanent magnets which are embedded in the intermediate wall 93 so as to allow electromagnetic ON/OFF signals to be sent thereto via the flexible cable 91. When electromagnetic force is turned on, steel plates 94 disposed on the cartridge 81 are attracted to be kept immovable. At the same time, contacts at the contact portion 84 come in good electrical contact with the opponent contacts 89 by the attractive force. Reference numeral 97 denotes tapered portions on the scanning section 82 side which come in contact with the tapered portions 95 of the cartridge stacker 85. In the same manner as the aforementioned ninth embodiment, a color ink cartridge (not shown) is mounted on a cartridge stacker (not shown) on the opposite side relative to the main scanning direction. Since black recording performed with the black ink cartridge 81 is the same as color recording performed with the color ink cartridge, description will be made below only with respect to the case of the black recording.

When the power source is turned on, the scanning section 82 is displaced to an initial position in the same manner as the ninth embodiment. When a recording signal is inputted, it is discriminated whether the recording signal is intended for black recording or color recording, and thereafter, the scanning section 82 moves toward the corresponding ink cartridge. In the case of the black recording, the scanning section 82 moves toward the black ink cartridge 81, and the tapered portions 97 of the scanning section 82 come in contact with the tapered portions of the cartridge stacker 85, causing the stacker 85 to be lowered. Subsequently, the tapered portions 97 of the scanning section 82 are received between both the tapered portions 95 and 96. And, the cartridge 81 moves to the upper part of the scanning section 82. When the solenoids 83 are turned on when the both contacts 84 and 89 come in contact with each other, the cartridge 81 is fixed onto the scanning section 82. Since the attractive force of the solenoids 83 is stronger than the attractive force of the magnet 90, when the scanning section 82 is separated from the stacker 85, the cartridge 81 moves together with the scanning section 82. After the scanning section 82 is integrated with the cartridge 81, the program goes to a recording operation in the same manner as the ninth embodiment.

In this embodiment, since a single flexible cable is used for the black ink cartridge 81 and the color ink cartridge on the common basis, an advantageous effect is such that the structure of the apparatus can be simplified. Since the ink cartridge is directly integrated with and parted from the scanning section 82, in contrast with the ninth embodiment, a quantity corresponding to the weight of the carriage can be allotted to the capacity of ink, causing a recording operation to be performed with an ink cartridge having a larger capacity. As a result, the recording operation is achieved at a reduced cost, and manhours required for exchanging the cartridge with another one can be reduced.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

Since the recording apparatus of the present invention is constructed such that the weight of an ink tank mounted on a carriage is detected within the scanning range of the carriage, an occurrence of malfunction of "no ink" or the like can reliably be prevented by exactly seizing variation of a quantity of ink remaining in the ink tank.

The recording apparatus of the present invention can exactly detected that ink is completely consumed by determining a quantity of usage of ink from the time when it is determined by the detected weight of the ink tank that a quantity of remaining ink is less than a predetermined quantity.

The recording apparatus of the present invention can avoid that it is forgotten that the ink tank is mounted on the carriage, by detecting the presence or absence of the ink tank mounted on the carriage.

The apparatus or instrument of the present invention including a scanning type carrier can exactly seize the state of a functional element by detecting the weight of the functional element mounted on the scanning type carrier, and moreover, exhibits the following advantageous effect.

Since the apparatus or instrument of the present invention is constructed such that first and second standby locations are determined on the one end side and the other end side as seen in the scanning direction of a carrier and a functional element to be held at the foregoing location is selectively mounted on the carrier, various manner of operation can be obtained corresponding to the kind of functional element mounted on the carrier. In addition, the functional element can be attached to and detached from the carrier merely by allowing the carrier to scan in one direction or in the other direction. Thus, the apparatus or instrument can simply be constructed and designed with smaller dimensions.

Since the apparatus or instrument of the present invention including a scanning type carrier is constructed such that a functional element is mounted on a carrier with the aid of a carriage for mounting the functional element, the functional element can easily be mounted merely by placing the carriage on the carrier.

Since the apparatus or instrument of the present invention including a scanning type carrier is constructed such that a carriage for mounting a functional element is swingably disposed in a guiding mechanism and swinging movement of the carriage is restricted by mounting the carriage on the carrier, a locating accuracy of the carriage can be lowered by engaging the carriage with a guiding member, causing the structure of the engagement portion to be simplified, and moreover, a high locating accuracy can be maintained when the carriage is mounted on the carrier.

Since the apparatus or instrument of the present invention including a scanning type carrier is constructed such that a receiving portion of the driving force for the carrier is located in the projected space as seen in the perpendicular direction relative to the scanning direction, the carrier can smoothly be scanned together with the carrier.

Since the apparatus or instrument of the present invention including a scanning type carrier is constructed such that before a carriage is engaged with the carriage, their relative positions are restricted, their engagement can reliably and smoothly be achieved.

Since the apparatus or instrument of the present invention including a scanning type carrier is constructed such that a functional element and electrical contacts are located by the carrier, their electrical connection can reliably be made.

Since the apparatus or instrument of the present invention including a scanning type carrier is constructed such that a carriage for mounting a functional element is swingably disposed in a guiding mechanism and swinging movement of the carriage is restricted by mounting the carriage on the carrier, a locating accuracy of the carriage can be lowered by engaging the carriage with a guide member, causing the structure of the engagement portion to be simplified, and moreover, a high locating accuracy can be maintained when the carriage is mounted on the carrier.

Since the apparatus or instrument of the present invention is constructed such that a receiving portion of the driving force for a carrier is located in the projected space as seen in the perpendicular direction relative to the scanning direction, the carrier can smoothly be scanned together with the carriage.

Since the apparatus or instrument of the present invention including a scanning type carrier is constructed such that before a carriage is engaged with the carrier, their relative positional relationship is restricted, their engagement can smoothly be made.

Since the apparatus or instrument of the present invention including a scanning type carrier is constructed such that ink jet heads held at first and second standby positions can selectively be scanned and a capping mechanism for capping each of the ink jet heads is provided, a recording operation can be performed using optimum ink jet head corresponding to the content of the recording operation, and moreover, an occurrence of malfunction of clogging can be prevented by the capping mechanism. Characters each having a high frequency of usage and color images can be recorded at a high speed. It is acceptable that an ink jet head which is not used for recording is kept capped. Since ink is not consumed for preliminary ejection and suction operation, and no time is consumed for achieving the preliminary ejection and the suction operation, a time required for performing recording can be shortened.

Since the apparatus or instrument of the present invention including a scanning type carrier is constructed such that a first standby position is used as a standby position exclusively usable for a carriage for mounting an ink jet head and a second standby position is used as a standby position exclusively usable for mounting a functional element different from the ink jet head, the ink jet head and the functional element different from the ink jet head are selectively scanned. Thus, various kind of operational manner can be assumed.

Since the apparatus or instrument of the present invention including a scanning type carrier is constructed such that a functional element to be integrated with the carrier is selected corresponding to a scanning mode of the apparatus or instrument and a driving signal of a functional element, an optimum functional element is automatically selected and then scanned.

The recording apparatus of the present invention can exactly seize the kind of a functional element and variation of the state of the same exchangeably mounted on a carriage by detecting the weight of a carriage.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed: is:

1. A recording apparatus comprising:

a carriage for mounting a recording head and an ink tank, said carriage being movable within a displacement range divided into a recording range for performing recording by said recording head and a range outside of the recording range; and detecting means for directly detecting the weight of an ink tank corresponding to a quantity of ink received in said ink tank, said detecting means being located outside of said recording range.

2. A recording apparatus as claimed in claim 1, further comprising:

judging means for judging a quantity of usage of ink in said ink tank when the detected weight of said detecting means becomes a predetermined weight or less.

3. A recording apparatus as claimed in claim 1, wherein said detecting means includes a determining level for determining the presence or absence of an ink tank to be mounted on said carriage.

4. An apparatus having a first end and a second end, the apparatus comprising:

a scanning type carrier for scanning on receipt of a driving force;

a first standby location for holding a functional element on one side of the apparatus at the first end thereof;

a second standby location for holding a functional element on another side of the apparatus at the second end thereof;

a guide mechanism for scanning said scanning type carrier in a scanning direction between said first standby location and said second standby location and for engaging with the functional element, said scanning type carrier being movable together with the functional element located at least at one of said first standby location and said second standby location; and detecting means for detecting the weight of at least one of said functional elements, said detecting means being located inside of a displacement range of said carrier but outside of a recording range as a part of said displacement range.

5. An apparatus as claimed in claim 4, further comprising:

a first carriage located at said first standby location for mounting a first functional element; and a second carriage located at said second standby location for mounting a second functional element, wherein said first carriage and said second carriage each include electrical contacts for activating said each functional element and a mechanism for positioning said each functional element, and said scanning carrier mounts one of said first functional element and said second functional element by placing one of said first and second carriages.

6. An apparatus as claimed in claim 5, wherein carriages including said first carriage and said second carriage are swingably engaged with said guiding mechanism; and further comprising:

a first mechanism and a second mechanism for restricting swinging movement of said first carriage and said second carriage at said first standby location and said second standby location, respectively, wherein said scanning type carrier includes an engagement mechanism for restricting swinging movement of said carriages in mounting one of said carriages thereon.

7. An apparatus as claimed in claim 6, wherein each of said functional element mounting carriages engages with said scanning type carrier so as to allow a receiving portion of the driving force of said scanning type carrier to intervene in a projected space of said carriage in a direction perpendicular to the scanning direction.

8. An apparatus as claimed in claim 7, wherein before receiving engagement for pulling/releasing with said scanning type carrier, each of said functional element mounting carriages performs restrictive engagement for restricting a relative positional relationship relative to said scanning type carrier.

9. An apparatus as claimed in claim 4, wherein said scanning type carrier comprises electrical contacts for activating a mounted functional element and a mechanism for positioning said mounted functional element.

10. An apparatus having a first end and a second end, the apparatus comprising:

a scanning type carrier;

a first standby location for mounting an ink jet head and an ink tank on one side of the apparatus at the first end thereof;

a second standby location for mounting an ink jet head and an ink tank on another side of the apparatus at the second end thereof;

a first capping mechanism for capping said ink jet head located at the first standby location;

a second capping mechanism for capping said ink jet head located at the second standby location;

a guide mechanism for scanning said scanning type carrier in a scanning direction between the first standby location and the second standby location, said scanning type carrier being movable together with the ink jet head and the ink tank located at either one of the first standby location and the second standby location; and detecting means for detecting the weight of at least one of said ink tanks, said detecting means being located inside of a displacement range of said carrier but outside of a recording range as part of said displacement range.

11. A recording apparatus for performing recording by scanning a carriage on which different functional elements are exchangeably mounted, said apparatus comprising:

a detecting mechanism which detects the weight of said carriage, said detecting mechanism being located inside of a displacement range of said carriage but outside of a recording range as a part of said displacement range.

12. An apparatus including a scanning type carriage for mounting a functional element thereon, said apparatus comprising:

a weight detecting mechanism which detects the weight of said carriage inclusive of said functional element, said detecting mechanism being located inside of a displacement range of said carriage but outside of a recording range as a part of said displacement range.

13. An apparatus as claimed in claim 12, wherein said weight detecting mechanism comprises:

a sensor portion for detecting the weight of said carriage and said functional element mounted on said carriage; and a lever portion for transmitting the weight of said carriage and said functional element mounted on said carriage to said sensor portion.

14. An apparatus as claimed in claim 13, wherein said lever portion of said weight detecting mechanism has a predetermined length and is turnable about a position located at a predetermined distance from said sensor portion, and when said carriage comes in contact with a predetermined range of said lever portion, said lever portion is turned to transmit the weight of said carriage and said functional element mounted on said carriage to said sensor portion.

15. An apparatus as claimed in claim 14 wherein said sensor portion and said lever portion are disposed while they are integrated with each other.

16. An apparatus as claimed in claim 14, wherein said sensor portion is disposed separately from said lever portion.

17. An apparatus as claimed in claim 13, wherein said weight detecting mechanism detects the weight of said carriage and said functional element mounted on said carriage based on a lever ratio of a distance from a center of turning movement of said lever portion to said sensor portion to a distance from the center of turning movement of said lever portion to a contact position of said carriage.

18. An apparatus as claimed in claim 13, wherein said weight detecting mechanism comprises:

means for preliminarily memorizing the relationship between a contact position of said carriage and a weight value detected by said sensor portion, and means for determining any one of the kind of said functional element mounted on said carriage and the presence or absence of said functional element depending on the contact position of said carriage When said weight detecting means gets an output and the content of said memorizing means.

19. An apparatus as claimed in claim 18, wherein said weight detecting means comprises means for amending the once set content of said memorizing means.

20. An apparatus as claimed in claim 14, wherein said weight detecting mechanism comprises:

calculating means for obtaining the detected weight from information on a contact position of said carriage when a lever ratio is preliminarily given; and determining means for determining any one of the kind of said functional element mounted on said carriage and the presence or absence of said functional element based on a result derived from calculation conducted by said calculating means.

21. An apparatus as claimed in claim 20, wherein said weight detecting means includes means for correcting a content of said calculating means.

22. A recording apparatus comprising:

a scanning carriage for mounting a functional element inclusive of an ink jet head for performing recording on a recording medium by ejecting ink and an ink tank for receiving ink to be supplied to said ink jet head; and weight detecting means for detecting a substantial weight of said carriage inclusive of said functional element inside of a displacement range of said carrier but outside of a recording range as a Part of said displacement range.

23. A recording apparatus as claimed in claim 22, wherein said ink jet head and said ink tank are attachable to and detachable from said carriage.

24. A recording apparatus as claimed in claim 23, wherein said ink tank is attachable to and detachable from said ink jet head.

25. A recording apparatus as claimed in claim 22, wherein said weight detecting means comprises;

a sensor portion for detecting the substantial weight of said carriage and said functional element mounted on said carriage, and a lever portion for transmitting the weight of said carriage and said functional element mounted on said carriage to said sensor portion.

26. A recording apparatus as claimed in claim 25, wherein said lever portion of said weight detecting means has a predetermined length and is turnable about the position located at a predetermined distance from said sensor portion, and in the case that said carriage comes in contact with a predetermined range of said lever portion, said lever is turned and transmits the weight of said carriage and said functional element mounted on said carriage to said sensor portion.

27. A recording apparatus as claimed in claim 26, wherein said sensor portion and said lever portion are disposed while they are integrated with each other.

28. A recording apparatus as claimed in claim 26, wherein said sensor portion is disposed separately from said lever portion.

29. A recording apparatus as claimed in claim 25, wherein said weight detecting means detects the weight of said carriage and said functional element mounted on said carriage based on a lever ratio of a distance from the turning movement center of said lever portion to said sensor portion to a distance from the turning movement center of said lever portion to the contact position of said carriage.

30. A recording apparatus as claimed in claim 22, wherein said weight detecting means comprises;

means for preliminarily memorizing the relationship between the contact position of said carriage and a weight value detected by said sensor portion, and judging means for judging any one of the kind of said functional element mounted on said carriage and the presence or absence of said functional element depending on the contact position of said carriage when said weight detecting means gets an output and the content of said memorizing means.

31. A recording apparatus as claimed in claim 30, wherein said weight detecting means comprises means for amending the once set content of said memorizing means.

32. A recording apparatus as claimed in claim 22, wherein said weight detecting means comprises;

calculating means for obtaining the detected weight from information on the contact position of said carriage in the case that a lever ratio is preliminarily given, and judging means for judging at least one of the kind of said functional element mounted on said carriage, the presence or absence of said functional element, and the weight of ink of said ink tank from the result derived from calculation conducted by said calculating means.

33. A recording apparatus as claimed in claim 32, wherein said weight detecting means includes means for correcting the content of said calculating means.

34. An ink jet recording apparatus comprising:

a carriage for mounting recording means for performing recording on a recording medium by ejecting ink, said carriage being supported to slide in a longitudinal direction of a guide shaft extending in parallel with a surface of said recording medium, and to turn about said guide shaft;

turning movement restricting means for restricting turning movement of said carriage;

weight detecting means, disposed within a sliding range of said carriage but outside of a recording range, for detecting at least the weight of said carriage; and a projection disposed on said carriage to transmit the weight of said carriage and said recording means mounted on said carriage to said weight detecting means by allowing said projection to come in contact with said weight detecting means to release restriction of the turning movement of said carriage induced by said turning movement restricting means.

35. An ink jet recording apparatus as claimed in claim 34, wherein said recording means includes an ink jet head for ejecting ink to said recording medium and an ink tank for receiving ink to be supplied to said ink jet head.

36. An ink jet recording apparatus as claimed in claim 35, wherein said ink jet head is attachable to and detachable from said carriage.

37. An ink jet recording apparatus as claimed in claim 36, wherein said ink tank is attachable to and detachable from said ink jet head.

38. An ink jet recording apparatus as claimed in claim 34, wherein said carriage turning movement restricting means is a retaining plate for restricting a distance between said recording medium and said recording means.

39. A remaining ink quantity detecting mechanism, comprising:

a carriage for mounting an ink tank for receiving ink to be supplied to an ink jet head for ejecting ink to a recording medium, said carriage being supported to slide in a longitudinal direction of a guide shaft extending in parallel with a surface of said recording medium, and to turn about said guide shaft;

weight detecting means, disposed within a sliding range of said carriage but outside of a recording range, for detecting at least the weight of said carriage; and a projection for transmitting the weight of said carriage and said ink tank mounted on said carriage to said weight detecting means by coming in contact with said weight detecting means.

40. A functional element discriminating method of discriminating a functional element mounted on a carriage slidable sliding in a predetermined direction, the method comprising the steps of:

actuating weight detecting means, arranged inside of a sliding range of said carriage but outside of a recording range, for detecting the weight of said carriage and said functional element by a projection disposed on said functional element; and discriminating a kind of said functional element from a result of detection.

41. A functional element discriminating method as claimed in claim 40, wherein the kind of said functional element is discriminated by allowing said carriage to stop at the position corresponding to the kind of said functional element by changing the position of said projection in the sliding direction of said carriage corresponding to the kind of said functional element.

42. A functional element discriminating mechanism for discriminating a functional element mounted on a carriage capable of sliding in a predetermined direction, comprising:

a projection disposed on said functional element;

weight detecting means for detecting the weight of said carriage and said functional element by contact of said projection, and discriminating means for discriminating the-kind of said functional element from the result of detection conducted by said weight detecting means.

43. A functional element discriminating mechanism as claimed in claim 42, wherein said projection is disposed at the position which is changed in the sliding direction of said carriage corresponding to the kind of said functional element, and said carriage is stopped at the position corresponding to the kind of said functional element.

44. A functional element discriminating mechanism as claimed in claim 43 further comprising;

judging means for judging the kind of said functional element mounted on said carriage and the state of the same by detecting the stop position of said carriage corresponding to the kind of said functional element, and moreover, detecting a detection level of said weight detecting means.

45. A functional element discriminating mechanism as claimed in claim 42, wherein said functional clement includes a plurality of projections, and in the case that said carriage is stopped at plural positions, the weight of said carriage is detected by said weight detecting means.

* * * * *

UNITED STATES PATENT AND TRADEMARK OFFICE

CERTIFICATE OF CORRECTION

PATENT NO. : 5,777,634

DATED : July 7, 1998

INVENTOR(S): YOSHITAKA OKAMURA ET AL.

It is certified that error appears in the above-identified patent and that said Letters Patent is hereby corrected as shown below:

ON COVER PAGE AT [56] U.S. PATENT DOCUMENTS

"5,165,708" should read --5,166,708--.

ON COVER PAGE AT [56] FOREIGN PATENT DOCUMENTS

"2605559" should read --26-05559--.

IN THE DRAWINGS

Figure 10B:
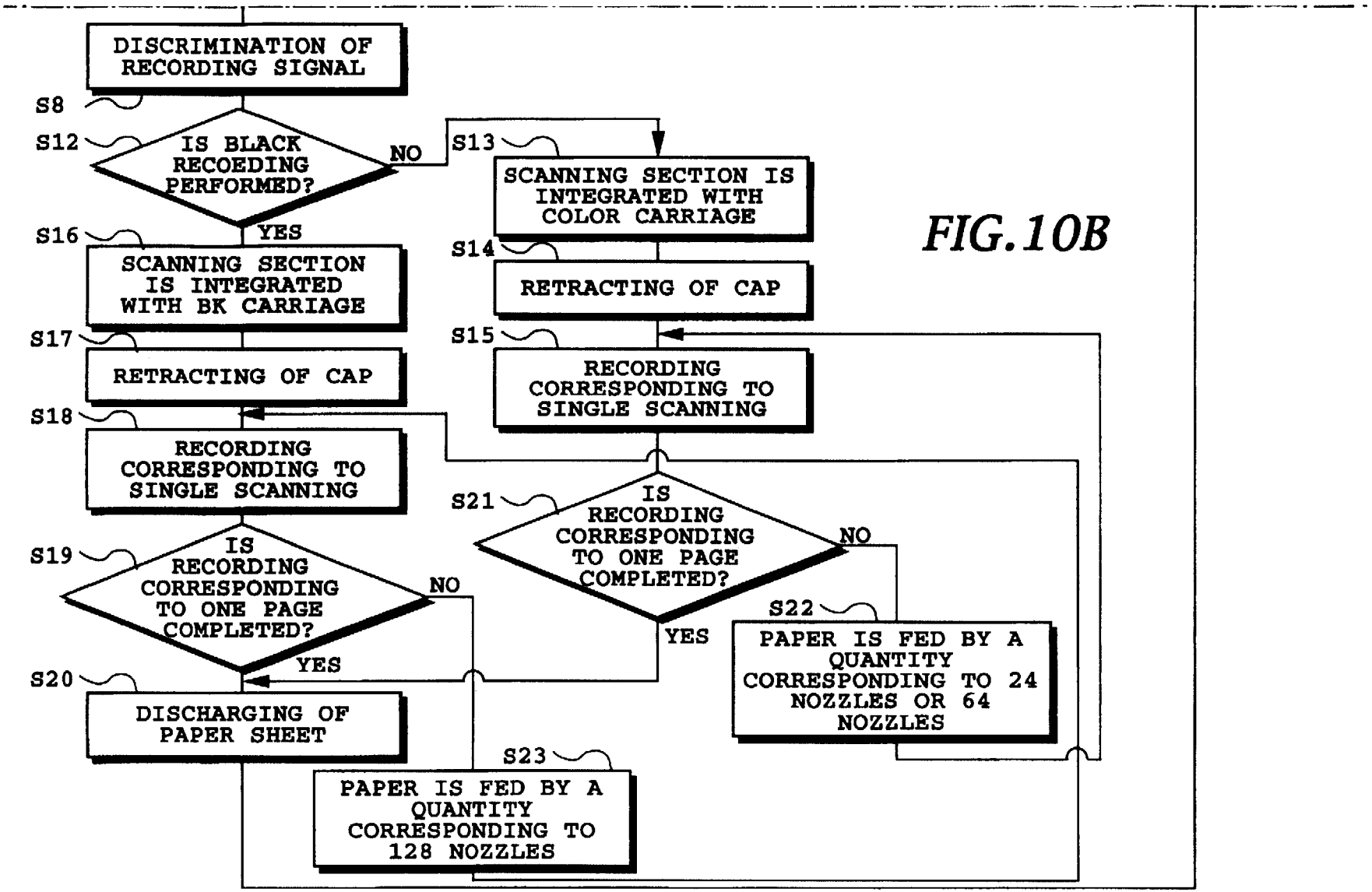

Fig. 10B, "RECOEDING" should read --RECORDING--.

COLUMN 1

Line 11, "kind" should read --kinds--;
Line 12, "becomes" should read --become--;
Line 32, "at a" should read --at an--;
Line 66, "much" should read --many--.

COLUMN 2

Line 26, "Other" should read --Another--;
Line 31, "manner" should read --manners--;
Line 38, "that" should read --that,--;
Line 62, "comprise:" should read --comprising:--.

UNITED STATES PATENT AND TRADEMARK OFFICE

CERTIFICATE OF CORRECTION

PATENT NO. : 5,777,634

DATED : July 7, 1998

INVENTOR(S): YOSHITAKA OKAMURA ET AL.

It is certified that error appears in the above-identified patent and that said Letters Patent is hereby corrected as shown below:

COLUMN 3

Line 4, "located at" should read --located by at--;
Line 13, "including" should read --include--;
Line 14, "the each" should read --each--;
Line 15, "the each" should read --each--;
Line 45, "comprises:" should read --comprising:--;
Line 67, "comprises:" should read --comprising:--.

COLUMN 4

Line 19, "direction, and detecting" should read --direction; and ¶ detecting--;
Line 25, "comprises;" should read --comprising;--
Line 48, "comprises;" should read --comprising;--
Line 63, "carrier," should read --carrier;--.

COLUMN 5

Line 2, "comprises;" should read --comprising;--;
Line 25, "comprises;" should read --comprising;--;
Line 43, "comprises;" should read --comprising;--.

COLUMN 6

Line 7, "comprises;" should read --comprising;--;
Line 59, "comprises;" should read --comprising;--.

UNITED STATES PATENT AND TRADEMARK OFFICE

CERTIFICATE OF CORRECTION

PATENT NO. : 5,777,634

DATED : July 7, 1998

INVENTOR(S): YOSHITAKA OKAMURA ET AL.

It is certified that error appears in the above-identified patent and that said Letters Patent is hereby corrected as shown below:

COLUMN 7

Line 53, "comprises;" should read --comprising;--.

COLUMN 8

Line 20, "comprises;" should read --comprising;--;
Line 39, "comprises " should read --comprising --;
Line 55, "comprises;" should read --comprising;--.

COLUMN 10

Line 37, "material," should read --materials,--;
Line 42, "includes" should read --include--.

COLUMN 11

Line 45, "phrase of" should read --phrase--.

COLUMN 12

Line 51, "weight of" should read --weight--.

COLUMN 14

Line 12, "101)" should read --101.)--.

UNITED STATES PATENT AND TRADEMARK OFFICE

CERTIFICATE OF CORRECTION

PATENT NO. : 5,777,634

DATED : July 7, 1998

INVENTOR(S): YOSHITAKA OKAMURA ET AL.

It is certified that error appears in the above-identified patent and that said Letters Patent is hereby corrected as shown below:

COLUMN 15

Line 53, "attached" should read --attached to--;
Line 62, "only" should read --only is--;
Line 67, "rank" should read --tank--.

COLUMN 16

Line 43, "determinate" should read --determine--;
Line 48, "tanks." should read --tank.--.

COLUMN 18

Line 34, "65" should read --65,--.

COLUMN 20

Line 50, "cartridge" should read --carriage--;
Line 52, "Qn" should read --on--;
Line 60, "other" should read --another--.

UNITED STATES PATENT AND TRADEMARK OFFICE

CERTIFICATE OF CORRECTION

PATENT NO. : 5,777,634

DATED : July 7, 1998

INVENTOR(S): YOSHITAKA OKAMURA ET AL.

It is certified that error appears in the above-identified patent and that said Letters Patent is hereby corrected as shown below:

COLUMN 22

Line 44, "denoted" should read --denotes--.

COLUMN 23

Line 40, "another" should read --other--.

COLUMN 24

Line 47, "seizes" should read --seize--;
Line 51, "inside the" should read --inside of the--;
Line 52, "sate" should read --state--.

COLUMN 26

Line 2, "unexpected" should read --an unexpected--.

COLUMN 27

Line 13, "stapes" should read --stages-- and "same" should read --the same--;
Line 64, "stapes" should read --stages-- and "same" should read --the same--.

UNITED STATES PATENT AND TRADEMARK OFFICE

CERTIFICATE OF CORRECTION

PATENT NO. : 5,777,634

DATED : July 7, 1998

INVENTOR(S): YOSHITAKA OKAMURA ET AL.

It is certified that error appears in the above-identified patent and that said Letters Patent is hereby corrected as shown below:

COLUMN 28

Line 7, "35 is" should read --35 are--;
Line 15, "is gripps" should read --grips--;
Line 20, "gripps" should read --grips--;
Line 21, "same" should read --the same--;
Line 56, "sense" should read --dense--;
Line 61, "type" should read --types--.

COLUMN 30

Line 3, "the both" should read --both the--.

COLUMN 31

Line 12, "may consists" should read --may consist--.

COLUMN 32

Line 19, "detected" should read --detect--;
Line 39, "manner" should read --manners--.

COLUMN 33

Line 3, "carriage" should read --carrier--;
Line 55, "kind" should read --kinds--.

UNITED STATES PATENT AND TRADEMARK OFFICE

CERTIFICATE OF CORRECTION

PATENT NO. : 5,777,634

DATED : July 7, 1998

INVENTOR(S): YOSHITAKA OKAMURA ET AL.

It is certified that error appears in the above-identified patent and that said Letters Patent is hereby corrected as shown below:

COLUMN 34

Line 20, "A" should read --The--;
Line 25, "A" should read --The--;
Line 52, "An" should read --The--;
Line 64, "An" should read --The--.

COLUMN 35

Line 9, "An" should read --The--;
Line 15, "An" should read --The--;
Line 21, "An" should read --The--;
Line 66, "An" should read --The--.

COLUMN 36

Line 6, "An" should read --The--;
Line 15, "An" should read --The--;
Line 18, "An" should read --The--;
Line 20, "An" should read --The--;
Line 27, "An" should read --The--;
Line 35, "When" should read --when--;
Line 39, "An" should read --The--;
Line 42, "An" should read --The--;
Line 52, "An" should read --The--;
Line 63, "Part" should read --part--;
Line 65, "A" should read --The--.

UNITED STATES PATENT AND TRADEMARK OFFICE

CERTIFICATE OF CORRECTION

PATENT NO. : 5,777,634

DATED : July 7, 1998

INVENTOR(S): YOSHITAKA OKAMURA ET AL.

It is certified that error appears in the above-identified patent and that said Letters Patent is hereby corrected as shown below:

COLUMN 37

Line 1, "A" should read --The--;
Line 4, "A" should read --The--;
Line 12, "A" should read --The--;
Line 21, "A" should read --The--;
Line 23, "A" should read --The--;
Line 26, "A" should read --The--;
Line 33, "A" should read --The--;
Line 45, "A" should read --The--;
Line 48, "A" should read --The--;
Line 58, "A" should read --The--.

COLUMN 38

Line 14, "An" should read --The--;
Line 18, "An" should read --The--;
Line 21, "An" should read --The--;
Line 25, "An" should read --The--;
Line 57, "A" should read --The--;

Line 66, "capable of sliding" should read --slidable--.

COLUMN 39

Line 4, "the-kind" should read --the kind--;
Line 7, "A" should read --The--;
Line 13, "A" should read --The--.

UNITED STATES PATENT AND TRADEMARK OFFICE

CERTIFICATE OF CORRECTION

PATENT NO. : 5,777,634

DATED : July 7, 1998

INVENTOR(S): YOSHITAKA OKAMURA ET AL.

It is certified that error appears in the above-identified patent and that said Letters Patent is hereby corrected as shown below:

COLUMN 40

Line 8, "A" should read --The--;
Line 9, "clement" should read --element--.

Signed and Sealed this

Fourteenth Day of September, 1999

*Attest:*

Q. TODD DICKINSON

*Attesting Officer*

*Acting Commissioner of Patents and Trademarks*